US005145765A

United States Patent [19]

Okamura et al.

[11] Patent Number: 5,145,765

[45] Date of Patent: * Sep. 8, 1992

[54] SILVER HALIDE PHOTOGRAPHIC MATERIAL

[75] Inventors: Hisashi Okamura; Kazunobu Katoh, both of Kanagawa, Japan

[73] Assignee: Fuji Photo Film Co., Ltd., Kanagawa, Japan

[ * ] Notice: The portion of the term of this patent subsequent to Feb. 4, 2009 has been disclaimed.

[21] Appl. No.: 746,810

[22] Filed: Aug. 14, 1991

Related U.S. Application Data

[63] Continuation of Ser. No. 520,479, May 8, 1990, abandoned.

[30] Foreign Application Priority Data

May 8, 1989 [JP] Japan ..... 1-114455

[51] Int. Cl.[5] ..... G03C 1/06

[52] U.S. Cl. ..... 430/264; 430/544; 430/566; 430/598; 430/957

[58] Field of Search ..... 430/222, 223, 264, 572, 430/566, 598, 957, 544, 546

[56] References Cited

U.S. PATENT DOCUMENTS

| | | | |
|---|---|---|---|
| 4,684,604 | 8/1987 | Harder | 430/375 |
| 4,914,002 | 4/1990 | Inoue et al. | 430/264 |
| 4,923,787 | 5/1990 | Harder | 430/489 |

FOREIGN PATENT DOCUMENTS

| | | | |
|---|---|---|---|
| 62-245263 | 10/1987 | Japan . | |
| 63-046450 | 2/1988 | Japan . | |
| 1-072140 | 3/1989 | Japan | 430/569 |

*Primary Examiner*—Marion E. McCamish
*Assistant Examiner*—Janis L. Dote
*Attorney, Agent, or Firm*—Sughrue, Mion, Zinn, Macpeak & Seas

[57] ABSTRACT

A silver halide photographic material which contains (a) at least one redox compound capable of releasing a development inhibitor by oxidation and (b) at least one compound represented by the following general formula (I):

$$R_1-Y_1-L_1-NHNHC(=O)-X_1 \quad (I)$$

wherein $R_1$ represents an aliphatic group, an aromatic group, or a heterocyclyl group; $L_1$ represents a divalent organic group; $X_1$ represents a hydrogen atom, an aliphatic group, an aromatic group, or a heterocyclyl group; and $Y_1$ represents —O—, —$SO_2NH$— or $$-Y_2-P(=O)(Y_2-R_1)-NH-$$

where $Y_2$ represents —O—, —NH—, or $$-N(R_1)-.$$

1 Claim, 1 Drawing Sheet

SILVER HALIDE PHOTOGRAPHIC MATERIAL

This is a continuation of application Ser. No. 07/520,479 filed May 8, 1990, now abandoned.

FILED OF THE INVENTION

This invention relates to a silver halide photographic material and, more particularly, to a silver halide photographic material which can provide a negative image with high contrast, a negative image with high photographic density, and an excellent halftone dot image quality.

BACKGROUND OF THE INVENTION

In the field of photomechanical processes, there are demands for photographic materials excellent in reproducibility of originals, stable processing solutions, simplification of replenishment and so on in order to cope with diversity and complexity of printed matter.

In particular, a line original used in the photograph-taking process is made by putting together photocomposed letters, handwritten letters, illustrations, halftone photographs and so on, so it has a mixture of images differing in density and line width from one another. Under such a situation, development of cameras for such processes, photographic light-sensitive materials and image forming methods as to duplicate line originals with good reproducibility have been strongly desired. In the photomechanical process for catalogs and large-sized posters, on the other hand, magnification (spread) or reduction (choke) of halftone photographs is prevailingly carried out. Since lines are sparsely present in the photomechanical process using expanded dots, photographs of blurred dots are taken. In the case of the reduction, the number of lines per inch becomes greater than those of the originals, so halftone photographs of the smaller dot areas are taken. Accordingly, image forming methods which can ensure much wider latitude than conventional ones have been required for retaining the reproducibility of halftone gradation.

As for the light source of a process camera, a halogen lamp or a xenon lamp is used. For the purpose of imparting the photograph-taking sensitivity to these light sources, photographic light-sensitive materials are generally subjected to orthochromatic sensitization. However, it has turned out that orthochromatically sensitized photographic materials undergo more strongly an influence of chromatic aberration, so the images formed therein tend to suffer deterioration in quality. The deterioration of this kind is more conspicuous when a xenon lamp is used as light source.

As a system which can meet the demand for wide latitude, it has been known that a lithographic silver halide photographic material comprising silver chlorobromide (having a silver chloride content of at least 50%) is processed with a hydroquinone developer in which the effective concentration of sulfite ion is extremely lowered (generally 0.1 mol/l or less) to obtain a line or dot image with a sufficiently high contrast and high optical density to clearly distinguish the image area from the non-image area.

In this system, however, the developer used is quite liable to air oxidation because of the low sulfite ion concentration, so various efforts and ideas have been made to maintain the developer activity constant. In the present situation, some of them, though practically used, are very slow in processing speed to result in the lowering of working efficiency.

Therefore, there has been a requirement for image forming systems of the kind which are not liable to the instability of image formation in the above-described developing method (lithographic developing system) by using a processing solution which has high storage stability upon development and, what is more, can provide superhigh contrast photographic characteristics. As one of such systems, there has been proposed a system wherein a surface latent image type silver halide photographic material containing a specific acylhydrazine compound as an additive is processed with a developer which contains a sulfite preservative in a concentration of at least 0.15 mol/l and is adjusted to pH 11.0–12.3 to produce a superhigh contrast negative image with a gamma value greater than 10, as disclosed in U.S. Pat. Nos. 4,166,742, 4,168,977, 4,221,857, 4,224,401, 4,243,739, 4,272,606 and 4,311,781. This new image-forming system has a characteristic that silver iodobromide and silver chloroiodobromide can be used in addition to silver chlorobromide, in contrast to the conventional system for forming a superhigh contrast image wherein only silver chlorobromide with a high chloride content is usable.

While the foregoing image forming system has excellent properties in respects of sharp quality of halftone image, stability and rapidity of processing, and reproducibility of an original, novel systems which can effect a further improvement in reproducibility of an original are desired in order to cope with the current diversity of printed matter. As for the lay out process and contact work, on the other hand, there is a striving for improvement in work efficiency through working in a better-lighted environment. With this aim, development of photographic materials for photomechanical use which can be handled in such an environment as to be called daylight in a substantial sense, and that of exposure printers have proceeded.

The term daylight photosensitive material as used herein describes a photographic material of the kind which can be handled safely for a long period of time using as a safe light the rays not including the ultraviolet portion but having in a substantial sense wavelengths of 400 nm or longer. The daylight photographic material to be employed in the lay out process and contact work is utilized for effecting negative-positive conversion or positive-positive reproduction by using as originals development-processed films having letter or halftone images, and subjecting the originals and a photographic material for contact work (hereinafter referred to as a "contact photographic material") to contact exposure, and it has been required of the daylight photographic material to have (1) the property of making it feasible for halftone, line and letter images to undergo negative image-positive image conversion faithfully in accordance with individual dot areas, line widths and letter image widths, respectively, and (2) the property of permitting the tone control of halftone images, and the line width control of line and letter images. So far, day light contact photographic materials capable of meeting such requirements have been provided.

However, in a high level of image-conversion work for forming letter images through the contact work from integrated originals, the conventional method of using a daylight photographic material and carrying out the contact work in daylight had a defect of providing letter images inferior in quality to those provided by the method of using a conventional darkroom contact photographic material and carrying out the contact work in a darkroom.

The method of forming letter images through the contact work from integrated originals is described in more detail below.

As shown in FIG. 1 hereinafter, a letter or line image-formed film (line original) (b) adhered to a transparent or translucent base (a) and a halftone image-formed film (half-tone original) (d) adhered to a transparent or translucent base (c) (wherein a polyethylene terephthalate film having a thickness of about 100 μm is generally used as the adhesive base) are superposed, and employed as an original. The emulsion surface of a photographic material for contact work (e) is brought into direct contact with the halftone original (d), and subjected to optical exposure.

After the exposure, the photographic material is development-processed to produce blank areas corresponding to line images inside the halftone images.

A point of importance in such a method for forming letter images is that the ideal of negative image-positive image conversion consists in accomplishing the conversion faithfully in accordance with individual dot areas of a halftone original and individual line widths of a line original, respectively. However, as is apparent from FIG. 1, the exposure for printing the line original (b) on the contact photographic material is carried out in a condition that the base (c) and the halftone original (d) are sandwitched in therebetween, in contrast to the exposure carried out in a condition that the halftone original (d) is in direct contact with the emulsion surface of the contact photosensitive material.

Therefore, an exposure determined as optimum for accomplishing faithful negative image-positive image conversion with respect to the halftone original is out of focus for the line original because the base (c) and the halftone image (d) are interposed as a spacer. As the result, narrowing of the line width of the blank area corresponding to the line original is caused. This is responsible for deterioration in quality of the letter image.

With the intention of overcoming the above-described point at issue, systems using a hydrazine compound are disclosed in JP-A-62-80640 (the term "JP-A" as used herein means an "unexamined published Japanese patent application"), JP-A-62-235938,JP-A-62-235939,JP-A-63-104046, JP-A-63-103235, JP-A-63-296031, JP-A-63-314541, and JP-A-64-13545. However, those systems cannot be said to be satisfactory, so it is to be desired that further improvements should be introduced thereinto.

As an attempt for making an improvement in image quality, there has been known a method of releasing a development inhibitor in such a distribution as to correspond to silver image from a redox compound containing a carbonyl group, as disclosed, e.g., in JP-A-61-213847. However, the method has defects that since the extension of halftone gradation is insufficient and the range of image-tone control is narrower than that in a lithographic development system; notwithstanding the use of the redox compound, the method cannot be a contrast development system to be submitted for photographing of halftone images; and further, as the nucleation activity becomes too high or insufficient depending on fluctuation in the developer composition (e.g., pH, sulfite ion concentration, etc.), the images obtained lack uniformity in quality to impair the value as commodities.

Therefore, development of photographic materials which enable the formation of high contrasty halftone images using a stable developer, and the control of image tone over a wide range has been desired.

SUMMARY OF THE INVENTION

A first object of this invention is to provide a photographic material which has a wide exposure latitude upon photographing of line originals, a superhigh contrasty characteristic (in particular a gamma value beyond 10), and high resolution.

A second object of this invention is to provide a superhigh contrast photographic material which can reproduce line originals in a good condition, and that with a high background density (Dmax).

A third object of this invention is to provide a superhigh contrast photographic material which has a wide exposure latitude upon photographing of halftone dot images, and excellent halftone qualities including high density, clear-cut outline of dots and uniformity in dot shape.

A fourth object of this invention is to provide a superhigh contrast photographic material which can produce an image whose quality undergoes only a slight influence of the fluctuation in composition of the developer used.

The above-described objects of this invention are attained with a silver halide photographic material which contains (a) at least one redox compound capable of releasing a development inhibitor by oxidation and (b) at least one compound represented by the following general formula (I):

$$R_1-Y_1-L_1-NHNHC(=O)-X_1 \quad (I)$$

wherein $R_1$ represents an aliphatic group, an aromatic group, or a heterocyclic group; $L_1$ represents a divalent organic group; $X_1$ represents a hydrogen atom, an aliphatic group, an aromatic group, or a heterocyclic group; and $Y_1$ represents —O—, —$SO_2NH$—, $$-Y_2-\underset{\underset{Y_2-R_1}{|}}{\overset{\overset{O}{\|}}{P}}-NH-$$

wherein $Y_2$ represents —O—, —NH—, or $$-\underset{\underset{R_1}{|}}{N}-.$$

Figures 1A, 1B, 1C, 1D, 1E:
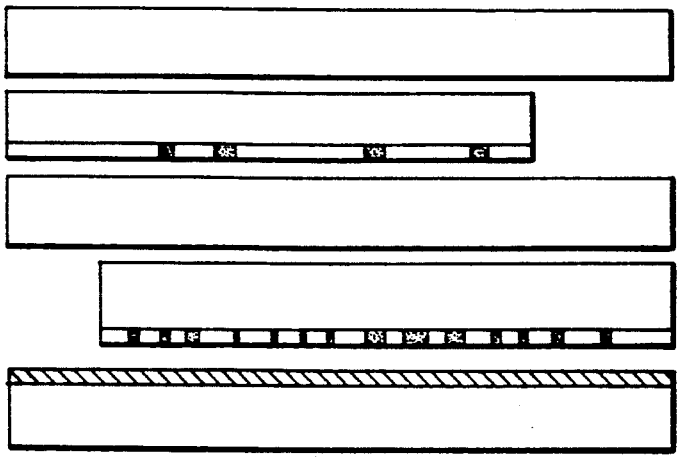
FIG. 1 shows a structure taken upon exposure for forming letter images in accordance with the contact work from integrated originals, and the marks affixed thereto refer to the following constituent materials, respectively.

(a) a transparent or translucent adhesive base, (b) a line original (the black part of which represents a line image, (c) a transparent or translucent adhesive base, (d) a halftone dot original (the black part of which represents the presence of dots), and (e) a photographic material for contact work (the shaded part of which represents a light-sensitive layer).

DETAILED DESCRIPTION OF THE INVENTION

The compound represented by the general formula (I) is described in detail below.

The aliphatic group represented by R is a straight-chain, branched or cyclic alkyl, alkenyl or alkynyl group, preferably one which contains 1 to 30 carbon atoms, and particularly preferably one which contains 1 to 20 carbon atoms. The branched alkyl group may be cyclized so as to form a saturated hetero ring containing one or more of a hetero atom.

As examples of such groups, mention may be made of a methyl group, a t-butyl group, an n-octyl group, a t-octyl group, a cyclohexyl group, a hexenyl group, a pyrrolidyl group, a tetrahydrofuryl group, an n-dodecyl group, and so on.

The aromatic group represented by $R_1$ is a monocyclic or dicyclic aryl group, such as a phenyl or naphthyl group.

The heterocyclic group represented by $R_1$ is a residue of a 3- to 10-membered saturated or unsaturated heterocyclic ring which contains at least one nitrogen, oxygen or sulfur atom. Such a ring may take a monocyclic form or form a condensed ring by being fused together with another aromatic or heterocyclic ring. Preferred heterocyclic groups among them include 5- to 6-membered aromatic heterocyclic groups, such as a pyridyl group, a imidazolyl group, a quinolinyl group, a benzimidazolyl group, a pyrimidinyl group, a pyrazolyl group, an isoquinolinyl group, a benzothiazolyl group, a thiazolyl group, and so on.

The group represented by $R_1$ may have one or more substituent groups, which may be the same or different. As for the substituent group, the following ones can be given as examples. These substituent groups may further be substituted.

Suitable examples of substituent groups include an alkyl group, an aralkyl group, an alkenyl group, an alkynyl group, an alkoxy group, an aryl group, a substituted amino group, an acylamino group, a sulfonylamino group, a ureido group, a urethane group, an aryloxy group, a sulfamoyl group, a carbamoyl group, an alkylthio group, an arylthio group, a sulfonyl group, a sulfinyl group, a hydroxy group, a halogen atom, a cyano group, a sulfo group, an aryloxycarbonyl group, an acyl group, an alkoxycarbonyl group, an acyloxy group, a carbonamido group, a sulfonamindo group, a carboxyl group, and so on.

These groups may combine with one another to form a ring, if possible.

The divalent organic group represented by $L_1$ is an aliphatic group, an aromatic group, or a group having the following structural formula:

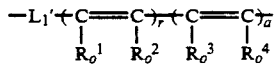

wherein $L_1'$ represents an aromatic group or a heterocyclic group; $R_o^1$ to $R_o^4$ each individually represent a hydrogen atom, a halogen atom or an alkyl group (preferably having 1 to 20 carbon atoms); and r and s each represents 0 or 1.

The aliphatic group represented by $L_1$ includes straight-chain, branched or cyclic alkylene, alkenylene and alkynylene groups preferably having 1 to 20 carbon atoms The aromatic group represented by L: includes monocyclic and bicyclic arylene groups preferably having 6 to 20 carbon atoms, such as a phenylene group and a naphthylene group. In particular, phenylene groups are preferred to other aromatic groups.

Groups preferred as $L_1$ are arylene groups, especially phenylene groups.

Further, $L_1$ may have a substituent group. As examples of such a substituent group, mention may be made of those cited above as substituent groups which $R_1$ may have, these substituents being in addition to $R_1$—$Y_1$—.

As for the aliphatic group represented by $X_1$ in the general formula (I), an alkyl group containing 1 to 20 carbon atoms (particularly 1 to 4 carbon atoms) is preferred, which may be substituted by a halogen atom, a cyano group, a carboxyl group, a sulfo group, an alkoxy group, a phenyl group, a sulfonyl group, an imido group, or so on.

As for the aromatic group represented by $X_1$, mono- and di-cyclic aryl groups, e.g., those containing a benzene ring are preferred. Such groups may be substituted by a halogen atom, an alkyl group, a cyano group, a carboxyl group, a sulfo group, a sulfonyl group, or so on.

In addition, $X_1$ may be such a group as to split off the moiety

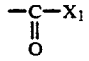

from the residual molecule and to undergo a cyclization reaction to result in the formation of a cyclic structure containing atoms of the moiety

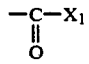

in the cyclic structure, and can be represented concretely by the general formula (a):

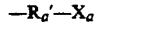

(a)

wherein $X_a$ is such a group as to make a nucleophilic attack against the carbonyl group to split off the moiety

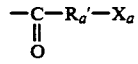

from the residual molecule; and $R_a'$ is the $X_1$ rest obtained by eliminating a hydrogen atom from $X_1$, and enables the formation of a cyclic structure using

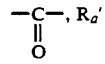

and —$X_a$ upon the nucleophilic attack of $X_a$ upon $$-\underset{\underset{O}{\|}}{C}-$$

More specifically, $X_a$ is a group capable of easily undergoing a nucleophilic reaction with the carbonyl group when the hydrazine compound of the general formula (I) produces the reaction intermediate, $$R_1-Y_1-L_1-N=N-\underset{\underset{O}{\|}}{C}-R_a'-X_a,$$

by oxidation or the like, and thereby splitting off the group $R_1-Y_1-L_1-N=N-$from the carbonyl group, with examples including functional groups capable of reacting directly with the carbonyl group, such as —OH, —SH, —$NHR_a^2$ (wherein $R_a^2$ represents a hydrogen atom, an alkyl group, an aryl group, —$COR_a^3$, or —$SO_2R_a^3$; and $R_a^3$ represents a hydrogen atom, an alkyl group, an aryl group, or a heterocyclic group), —COOH or the like, (wherein OH, SH, $NHR_a^2$ and COOH may be temporarily protected so as to produce these groups each by hydrolysis using an alkali or the like), and functional groups capable of coming to react with the carbonyl group through the reaction with a nucleophilic reagent (e.g., hydroxide ion, sulfite ion), such as $$-\overset{\overset{O}{\|}}{C}-R_a^4,\ -\overset{\overset{N-R_a^5}{\|}}{C}-R_a^4$$

(wherein $R_a^4$ and $R_a^5$ are each a hydrogen atom, an alkyl group, an alkenyl group, an aryl group, or a heterocyclic group), and so on.

A preferred ring formed by the carbonyl group, $R_a'$ and $X_a$ is a 5- or 6-membered one.

Among the moieties represented by the general formula (a), those represented by the general formula (b) and those represented by the general formula (c) are preferred over others.

General formula (b)

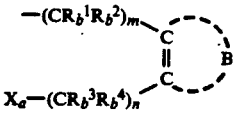

(b)

In the foregoing formula (b), $R_b^1$ to $R_b^4$ may be the same or different and each represents a hydrogen atom, an alkyl group (preferably containing 1 to 12 carbon atoms), an alkenyl group (preferably containing 2 to 12 carbon atoms), or an aryl group (preferably containing 6 to 12 carbon atoms); B represents atoms necessary to complete an optionally substituted 5- or 6-membered ring (the substituents being selected from the same group as for $R_1$); m and n each represents 0 or 1, provided that n+m is 1 or 2.

Specific examples of a 5- or 6-membered ring completed by B include a cyclohexene ring, a cycloheptene ring, a benzene ring, a naphthalene ring, a pyridine ring, and a quinoline ring.

$X_a$ has the same meaning as in the general formula (a).

$$-\overset{\overset{R_c^3}{|}}{(N)_p}-(CR_c^1R_c^2)_qX_a \qquad \text{(c)}$$

In the above formula (c), $R_c^1$ and $R_c^2$ may be the same or different and each represents a hydrogen atom, an alkyl group (preferably containing 1 to 12 carbon atoms), an alkenyl group (preferably containing 2 to 12 carbon atoms), an aryl group (preferably containing 6 to 12 carbon atoms) or a halogen atom.

$R_c^3$ represents a hydrogen atom, an alkyl group (preferably containing 1 to 12 carbon atoms), an alkenyl group (preferably containing 2 to 12 carbon atoms), or an aryl group (preferably containing 6 to 12 carbon atoms). p represents 0 or 1, and q represents an integer from 1 to 4.

$R_c^1$, $R_c^2$ and $R_c^3$ may form a ring by combining with one another so far as they can retain such a structure as to enable the intramolecular nucleophilic attack of $X_a$ upon the carbonyl group.

$R_c^1$ and $R_c^2$ each is preferably a hydrogen atom, a halogen atom or an alkyl group, and $R_c^3$ is preferably an alkyl group or an aryl group.

q is preferably an integer from 1 to 3. When q is 1, p represents 1, when q is 2, p represents 0 or 1, and when q is 3, p represents 0 or 1. When q is 2 or 3, $(R_c^1R_c^2)$'s may be the same or different.

$X_a$ has the same meaning as in the general formula (a).

$R_1$, $Y_1$, $L_1$ or $X_1$ in the general formula (I) may be a group into which such a ballast group as to be usually used in a nondiffusible photographic additive like a coupler is introduced. The ballast group is a group containing at least 8 carbon atoms and being comparatively inert to photographic properties, and can be chosen from among alkyl groups, alkoxy groups, phenyl groups, alkylphenyl groups, phenoxy groups, alkylphenoxy groups, and so on.

Specific examples of the compounds represented by the general formula (I) are illustrated below. However, the invention should not be construed as being limited to the following compounds.

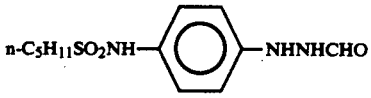

1-1

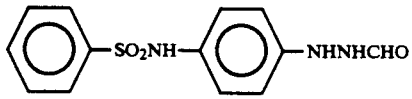

1-2

-continued
1-3
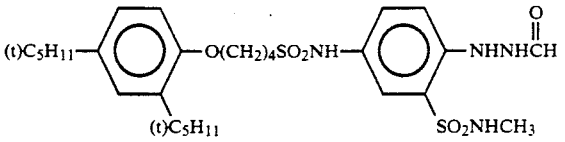
1-4
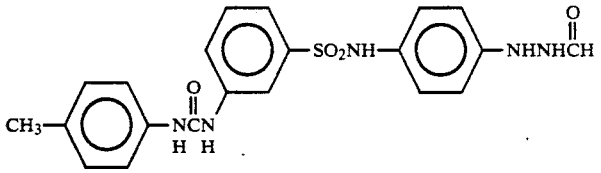
1-5
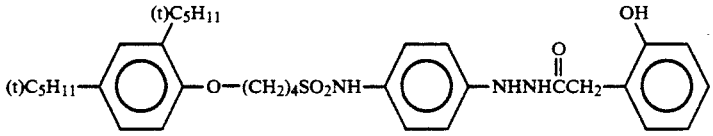
1-6
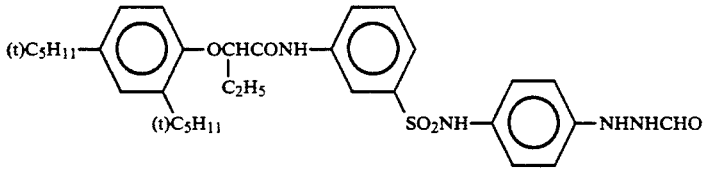
1-7
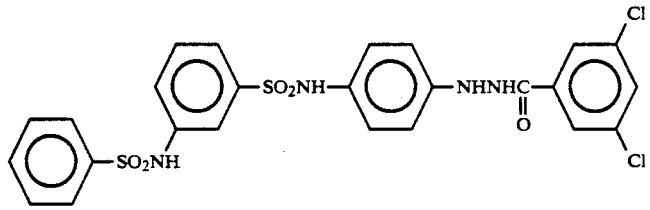
1-8
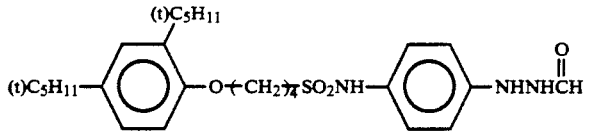
1-9
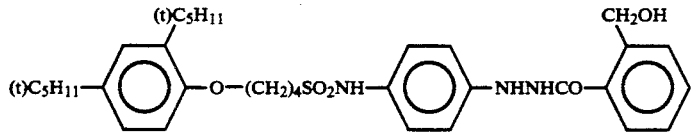
1-10
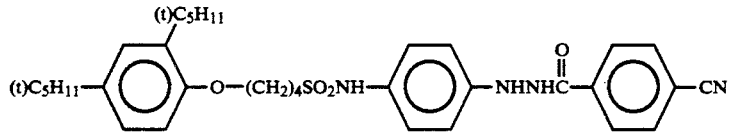
1-11
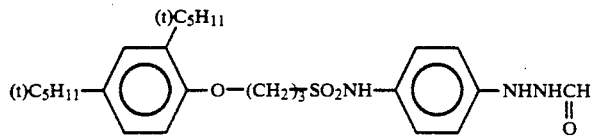

-continued
1-12
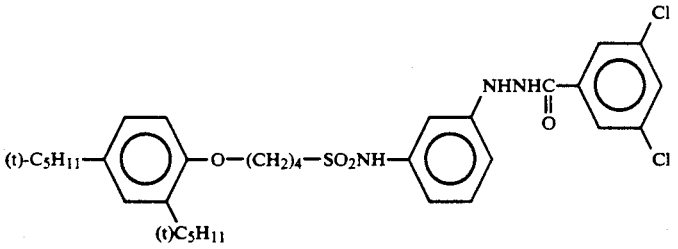
1-13
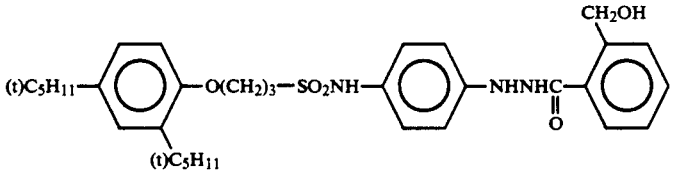
1-14
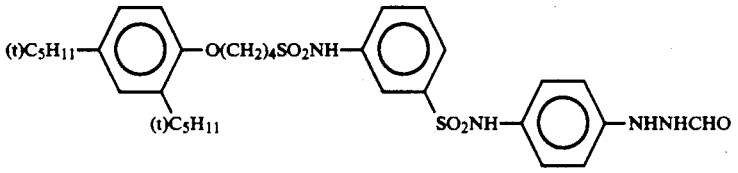
1-15
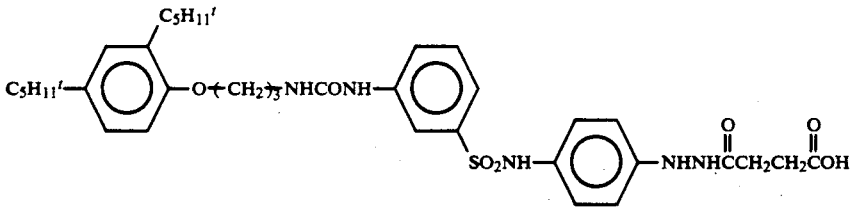
1-16
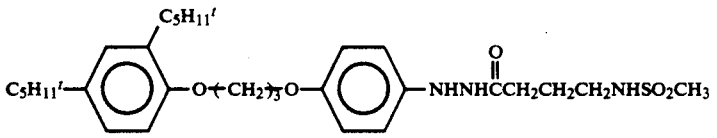
1-17
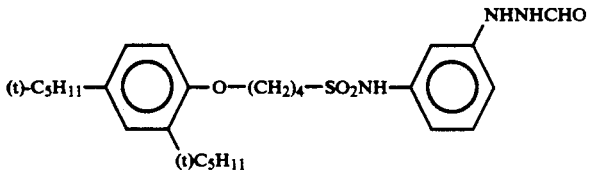
1-18
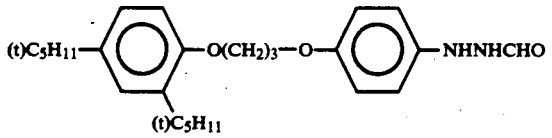
1-19
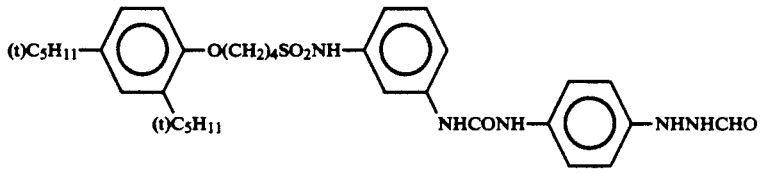
1-20
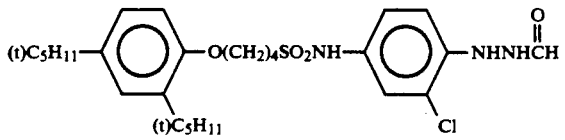

-continued 1-21

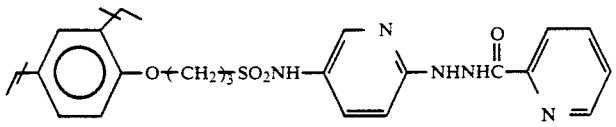

1-22

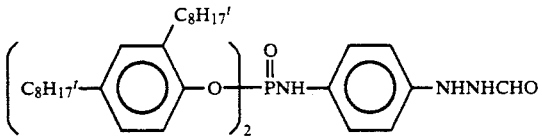

1-23

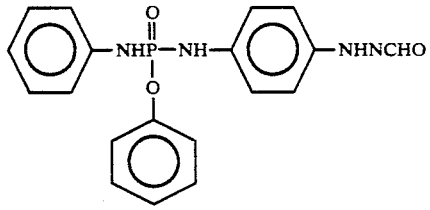

1-24

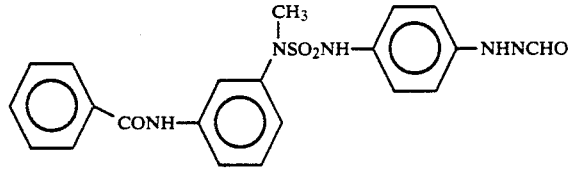

1-25

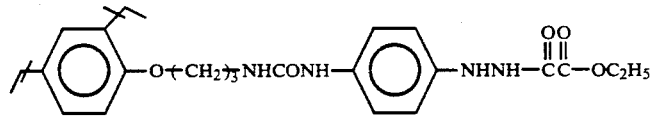

1-26

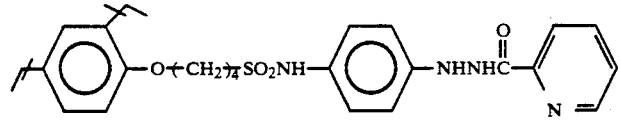

The redox compounds which release development inhibitor as a result of oxidation are described below.

The redox compounds of the present invention include hydroquinones, catechols, naphthohydroquinones, aminophenols, pyrazolidones, hydrazines, hydroxylamines or reductones as the redox group.

The preferred redox compounds are distinguished by having hydrazines as the redox group.

Moreover, the most preferred of the aforementioned redox groups are within compounds represented by the general formula (II) below.

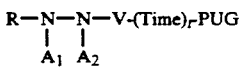

(II)

In this formula, both $A_1$ and $A_2$ represent hydrogen atoms, or one represents a hydrogen atom and the other represents a sulfinic acid residual group or

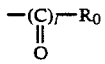

(wherein $R_0$ represents an alkyl group, an alkenyl group, an aryl group, an alkoxy group or an aryloxy group, and l represents 1 or 2). Time represents a divalent linking group, and t represents 0 or 1. PUG (photographically useful group) represents a development inhibitor. V represents a carbonyl group,

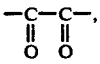

a sulfonyl group, a sulfoxy group,

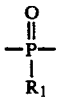

(wherein $R_1$ represents an alkoxy group or an aryloxy group), an iminomethylene group or a thiocarbonyl group. R represents an aliphatic group, an aromatic group or a heterocyclic group.

General formula (II) is described in detail below.

$A_1$ and $A_2$ in general formula (II) are hydrogen atoms, alkylsulfonyl or arylsulfonyl groups which do not have more than 20 carbon atoms (preferably phenylsulfonyl groups or substituted phenylsulfonyl groups in which the sum of the Hammett's substituent constants is at least −0.5),

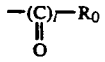

(wherein $R_0$ is preferably a linear chain, branched or cyclic alkyl group, an alkenyl group or an aryl group (preferably a phenyl group or a substituted phenyl group of which the sum of the Hammett substituent group constants is at least −0.5) which does not have more than 30 carbon atoms, an alkoxy group which does not have more than 30 carbon atoms (for example, ethoxy), or an aryloxy group which does not have more than 30 carbon atoms (which preferably has a single ring). These groups may have substituent groups, examples of which are indicated below. For example, the substituent groups may be alkyl groups, aralkyl groups, alkenyl groups, alkoxy groups, aryl groups, substituted amino groups, acylamino groups, sulfonylamino groups, ureido groups, urethane groups, aryloxy groups, sulfamoyl groups, carbamoyl groups, alkylthio groups, arylthio groups, sulfonyl groups, sulfinyl groups, hydroxyl groups, halogen atoms, cyano groups, sulfo or carboxyl groups, aryloxycarbonyl groups, acyl groups, alkoxycarbonyl groups, acyloxy groups, carboxamido groups, sulfonamido groups and nitro groups. And these substituent groups may also have substituent groups. Specific examples of sulfinic acid residual groups which can be represented by $A_1$ and $A_2$ include those disclosed in U.S. Pat. No. 4,478,928.

Furthermore, $A_1$ may be joined with $-(Time)_t-$ as described hereinafter to form a ring.

$A_1$ and $A_2$ are most preferably hydrogen atoms.

Time represents a divalent linking group and has a timing adjustment function. Moreover, t represents 0 or 1, and when=0, the PUG is bonded directly to V.

The divalent linking groups represented by Time are groups which release PUG via a simple stage or multiple stage reaction from the Time-PUG moiety which in turn is released from the oxidized form of the parent redox nucleus.

Examples of divalent linking groups which can be represented by Time include: (1) those in which a PUG is released via an intramolecular ring closing reaction of a p-nitrophenoxy derivative as disclosed, for example, in U.S. Pat. No. 4,248,962 (JP-A-54-145135); (2) those in which a PUG is released via an intramolecular ring closing reaction after ring cleavage as disclosed, for example, in U.S. Pat. No. 4,310,612 (JP-A-55-53330); (3) those in which a PUG is released with the formation of an acid anhydride by means of the intramolecular ring closing reaction of the carboxyl group of a monoester of succinic acid or a derivative thereof as disclosed, for example, in U.S. Pat. Nos. 4,330,617, 4,446,216 and 4,483,919, and JP-A-59-121,328; (4) those in which a PUG is released with the formation of a quinomonomethane or a derivative thereof by means of an electron transfer via conjugated double bonds of an aryloxy group or a heterocyclic oxy group as disclosed, for example, in U.S. Pat. Nos. 4,409,323 and 4,421,845, *Research Disclosure*, No. 21228 (December, 1981), U.S. Pat. No. 4,416,977 (JP-A-57-135944), JP-A-58-209736 and JP-A-58-209738; (5) those in which a PUG is released from the y-position of an enamine by means of electron transfer on the part of a nitrogen containing heterocyclic enamine structure as disclosed, for example, in U.S. Pat. No. 4,420,554 (JP-A-57-136640), JP-A-57-135945, JP-A-57-188035, JP-A-58-98728 and JP-A-58-209737; (6) those in which a PUG is released by means of an intramolecular ring closing reaction of an oxy group which is formed by electron transfer to a carbonyl group which is conjugated with the nitrogen atom of a nitrogen containing heterocyclic ring as disclosed in JP-A-57-56837; (7) those in which a PUG is released with the formation of an aldehyde as disclosed, for example, in U.S. Pat. No. 4,146,396 (JP-A-52-90932), JP-A-59-93442, and JP-A-59-75475; (8) those in which a PUG is released with the decarbonization of a carboxyl group as disclosed in GB 1531927 (JP-A-51-146828), JP-A-57-179842 and JP-A-59-104641; (9) those which have a $-O-COOCR_aR_b-PUG$ structure (wherein $R_a$ and $R_b$ each is a monovalent group) and which release a PUG via the reaction of the aldehyde following decarboxylation; (10) those in which a PUG is released with the formation of an isocyanate as disclosed in U.S. Pat. No. 4,546,073 (JP-A-60-7429); and (11) those in which a PUG is released by means of a coupling reaction with the oxidized form of a color developing agent as disclosed, for example, in U.S. Pat. No. 4,438,193. (The term "JP-A" as used herein means an "unexamined published Japanese patent application".)

Moreover, specific examples of divalent linking groups which can be represented by Time are described in detail, for example, in JP-A-61-236549 and JP-A-1-269936, and specific preferred examples are indicated below.

Here, (*) signifies the position at which, in general formula (II), $-(Time)_t-PUG$ is bonded to V, and (*)(*) signifies the position to which the PUG is bonded.

T-(1)

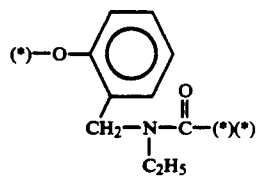

T-(2)

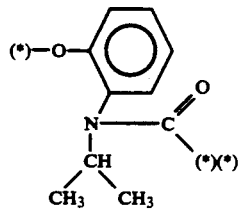

T-(3)

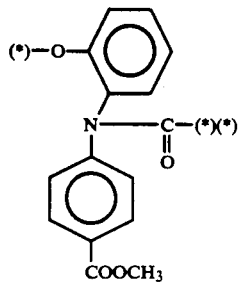

-continued
T-(4)
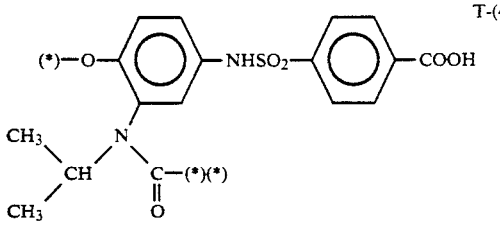
T-(5)
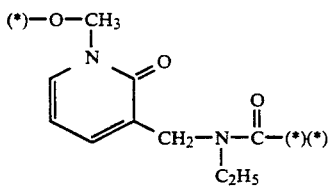
T-(6)
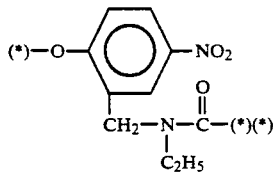
T-(7)
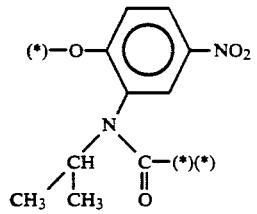
T-(8)
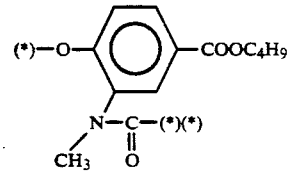
T-(9)
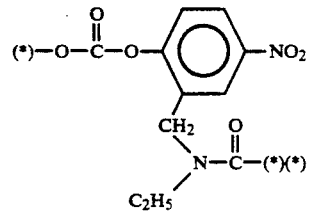
T-(10)
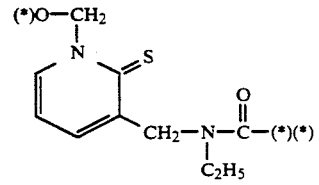
-continued
T-(11)
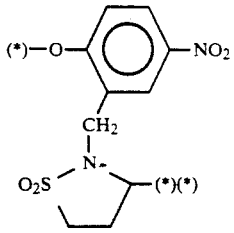
T-(12)
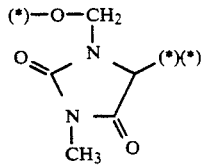
T-(13)
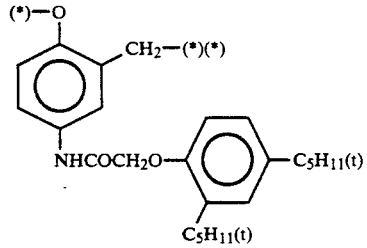
T-(14)
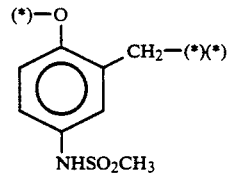
T-(15)
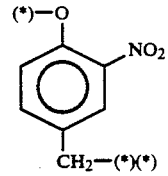
T-(16)
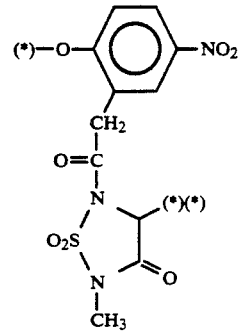
T-(17)
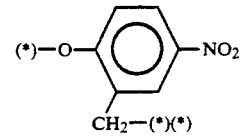

-continued
T-(18)
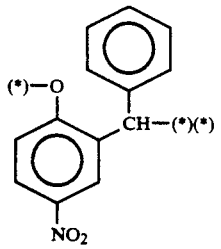
T-(19)
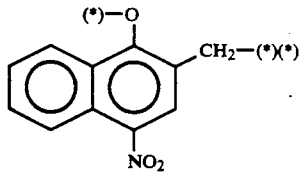
T-(20)
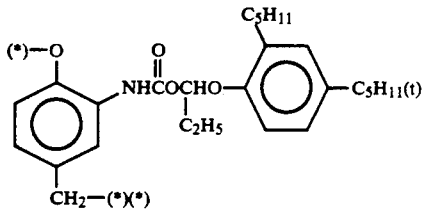
T-(21)
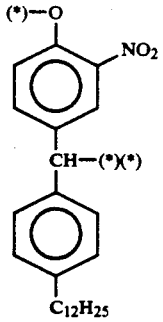
T-(22)
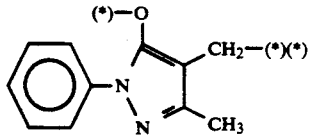
T-(23)
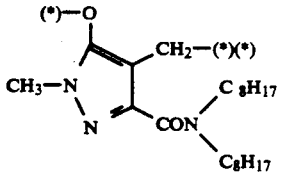
T-(24)
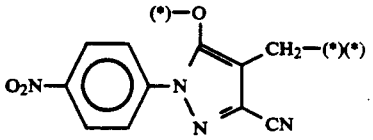
T-(25)
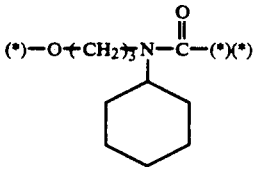
-continued
T-(26)
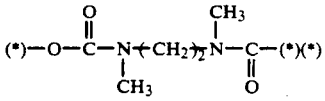
T-(27)
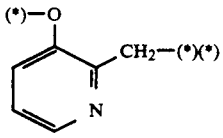
T-(28)
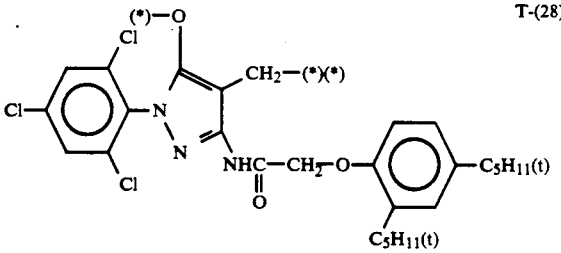
T-(29)
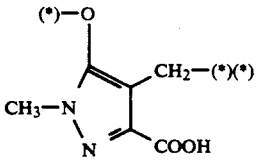
T-(30)
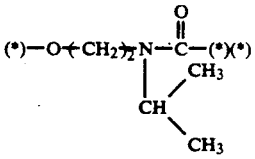
T-(31)
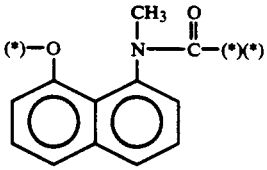
T-(32)
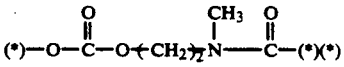
T-(33)
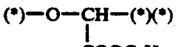
T-(34)
T-(35)
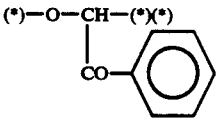
T-(36)
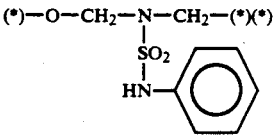

-continued

T-(37)

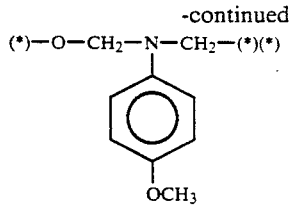

T-(38)

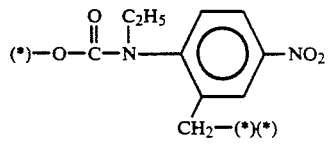

T-(39)

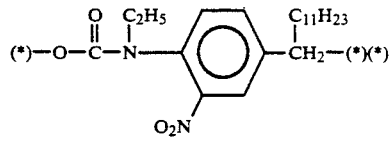

T-(40)

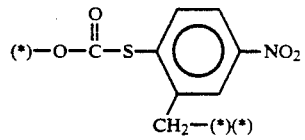

T-(41)

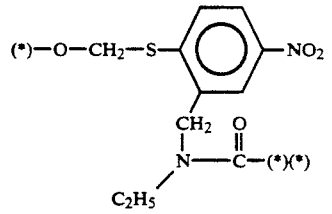

T-(42)

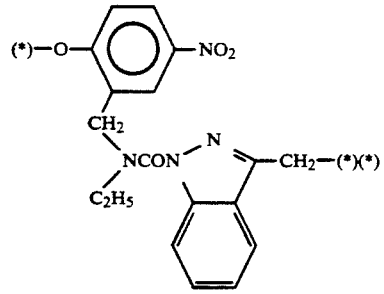

PUG represents a group which, either above or in combination with $(Time)_t$ has a development inhibiting action.

Development inhibitors represented by PUG or $(Time)_t$-PUG are known development inhibitors which have a hetero atom and which are bonded via a hetero atom, and they have been described, for example, by C. E. K. Mees and T. H. James in *The Theory of Photographic Processes*, Third Edition, 1966, pages 344–346, published by Macmillan. Categories of inhibitors include mercaptotetrazoles, mercaptotriazoles, mercaptoimidazoles, mercaptopyrimidines, mercaptobenzimidazoles, mercaptobenzthiazoles, mercaptobenzoxazoles, mercaptothiadiazoles, benztriazoles, benzimidazoles, indazoles, adenines, guanines, tetrazoles, tetraazaindenes, triazaindenes and mercaptoaryls.

The development inhibitors represented by PUG may be substituted. Some examples of substituent groups are indicated below, and these groups may be further substituted with substituent groups.

The substituent groups may be alkyl groups, aralkyl groups, alkenyl groups, alkynyl groups, alkoxy groups, aryl groups, substituted amino groups, acylamino groups, sulfonylamino groups, ureido groups, urethane groups, aryloxy groups, sulfamoyl groups, carbamoyl groups, alkylthio groups, arylthio groups, sulfonyl groups, sulfinyl groups, hydroxyl groups, halogen atoms, cyano groups, nitro groups, sulfo groups, alkyloxycarbonyl groups, aryloxycarbonyl groups, acyl groups, alkoxycarbonyl groups, acyloxy groups, carboxamido groups, sulfonamido groups, carboxyl groups, sulfoxy groups, phosphono groups, phosphinyl groups and phosphoric acid amido groups.

The preferred substituent groups are nitro groups, sulfo groups, carboxyl groups, sulfamoyl groups, phosphono groups, phosphinyl groups and sulfonamido groups.

The principal development inhibitors are indicated below:

1. Mercaptotetrazole Derivatives:
(1) 1-Phenyl-5-mercaptotetrazole
(2) 1-(4-Hydroxyphenyl)-5-mercaptotetrazole
(3) 1-(4-Aminophenyl)-5-mercaptotetrazole
(4) 1-(4-Carboxyphenyl)-5-mercaptotetrazole
(5) 1-(4-Chlorophenyl)-5-mercaptotetrazole
(6) 1-(4-Methylphenyl)-5-mercaptotetrazole
(7) 1-(2,4-Dihydroxyphenyl)-5-mercaptotetrazole
(8) 1-(4-Sulfamoylphenyl)-5-mercaptotetrazole
(9) 1-(3-Carboxyphenyl)-5-mercaptotetrazole
(10) 1-(3,5-Dicarboxyphenyl)-5-mercaptotetrazole
(11) 1-(4-Methoxyphenyl)-5-mercaptotetrazole
(12) 1-(2-Methoxyphenyl)-5-mercaptotetrazole
(13) 1-[4-(2-Hydroxyethoxy)phenyl]-5-mercaptotetrazole
(14) 1-(2,4-Dichlorophenyl)-5-mercaptotetrazole
(15) 1-(4-Dimethylaminophenyl)-5-mercaptotetrazole
(16) 1-(4-Nitrophenyl)-5-mercaptotetrazole
(17) 1,4-Bis(5-mercapto-1-tetrazolyl)benzene
(18) 1-(α-naphthyl)-5-mercaptotetrazole
(19) 1-(4-Sulfophenyl)-5-mercaptotetrazole
(20) 1-(3-Sulfophenyl)-5-mercaptotetrazole
(21) 1-(β-Naphthyl}-5-mercaptotetrazole
(22) 1-Methyl-5-mercaptotetrazole
(23) 1-Ethyl-5-mercaptotetrazole
(24) 1-Propyl-5-mercaptotetrazole
(25) 1-Octyl-5-mercaptotetrazole
(26) 1-Dodecyl-5-mercaptotetrazole
(27) 1-Cyclohexyl-5-mercaptotetrazole
(28) 1-Palmityl-5-mercaptotetrazole
(29) 1-Carboxyethyl-5-mercaptotetrazole
(30) 1-(2,2-Diethoxyethyl)-5-mercaptotetrazole
(31) 1-(2-Aminoethyl)-5-mercaptotetrazole hydrochloride
(32) 1-(2-Diethylaminoethyl)-5-mercaptotetrazole
(33) 2-(5-Mercapto-1-tetrazol)ethyltrimethylammonium chloride
(34) 1-(3-Phenoxycarbonylphenyl)-5-mercaptotetrazole
(35) 1-(3-Maleineimidophenyl)-5-mercaptotetrazole 2. Mercaptotriazole Derivatives:
(1) 4-Phenyl-3-mercaptotriazole
(2) 4-Phenyl-5-methyl-3-mercaptotriazole
(3) 4,5-Diphenyl-3-mercaptotriazole
(4) 4-(4-Carboxyphenyl)-3-mercaptotriazole
(5) 4-Methyl-3-mercaptotriazole
(6) 4-(2-Dimethylaminoethyl)-2-mercaptotriazole
(7) 4-(α-Naphthyl)-3-mercaptotriazole (8) 4-(4-Sulfophenyl)-3-mercaptotriazole
(9) 4-(3-Nitrophenyl)-3-mercaptotriazole
3. Mercaptoimidazole Derivatives:
(1) 1-Phenyl-2-mercaptoimidazole
(2) 1,5-Diphenyl-2-mercaptoimidazole
(3) 1-(4-Carboxyphenyl}-2-mercaptoimidazole
(4) 1-(4-Hexylcarbamoyl)-2-mercaptoimidazole
(5) 1-(3-Nitrophenyl)-2-mercaptoimidazole
(6) 1-(4-Sulfophenyl)-2-mercaptoimidazole
4. Mercaptopyrimidine Derivatives:
(1) Thiouracil
(2) Methylthiouracil
(3) Ethylthiouracil
(4) Propylthiouracil
(5) Nonylthiouracil
(6) Aminothiouracil
(7) Hydroxythiouracil
5. Mercaptobenzimidazole Derivatives:
(1) 2-Mercaptobenzimidazole
(2) 5-Carboxy-2-mercaptobenzimidazole
(3) 5-Amino-2-mercaptobenzimidazole
(4) 5-Nitro-2-mercaptobenzimidazole
(5) 5-Chloro-2-mercaptobenzimidazole
(6) 5-Methoxy-2-mercaptobenzimidazole
(7) 2-Mercaptonaphthimidazole
(8) 2-Mercapto-5-sulfobenzimidazole
(9) 1-(2-Hydroxyethyl)-2-mercaptobenzimidazole
(10) 5-Caproamido-2-mercaptobenzimidazole
(11) 5-(2-Ethylhexanoylamino)-2-mercaptobenzimidazole
6. Mercaptothiadiazole Derivatives:
(1) 5-Methylthio-2-mercapto-1,3,4-thiadiazole
(2) 5-Ethylthio-2-mercapto-1,3,4-thiadiazole
(3) 5-(2-Dimethylaminoethylthio)-2-mercapto-1,3,4-thiadiazole
(4) 5-(2-Carboxypropylthio)-2-mercapto-1,3,4-thiadiazole
(5) 2-Phenoxycarbonylmethylthio-5-mercapto-1,3,4-thiadiazole
7. Mercaptobenzthiazole Derivatives:
(1) 2-Mercaptobenzthiazole
(2) 5-nitro-2-mercaptobenzthiazole
(3) 5-Carboxy-2-mercaptobenzthiazole
(4) 5-Sulfo-2-mercaptobenzthiazole
8. Mercaptobenzoxazole Derivatives:
(1) 2-Mercaptobenzoxazole
(2) 5-Nitro-2-mercaptobenzoxazole
(3) 5-Carboxy-2-mercaptobenzoxazole
(4) 5-Sulfo-2-mercaptobenzoxazole
9. Benztriazole Derivatives:
(1) 5,6-Dimethylbenzotriazole
(2) 5-Butylbenzotriazole
(3) 5-Methylbenzotriazole
(4) 5-Chlorobenzotriazole
(5) 5-Bromobenzotriazole
(6) 5,6-Dichlorobenzotriazole
(7) 4,6-Dichlorobenzotriazole
(8) 5-Nitrobenzotriazole
(9) 4-Nitro-6-chlorobenzotriazole
(10) 4,5,6-Trichlorobenzotriazole
(11) 5-Carboxybenzotriazole
(12) 5-Sulfobenzotriazole, sodium salt
(13) 5-Methoxycarbonylbenzotriazole
(14) 5-Aminobenzotriazole
(15) 5-Butoxybenzotriazole
(16) 5-Ureidobenzotriazole
(17) Benzotriazole
(18) 5-Phenoxycarbonylbenzotriazole
(19) 5-(2,3-Dichloropropyloxycarbonyl)benzotriazole
10. Benzimidazole Derivatives:
(1) Benzimidazole
(2) 5-Chlorobenzimidazole
(3) 5-Nitrobenzimidazole
(4) 5-n-Butylbenzimidazole
(5) 5-Methylbenzimidazole
(6) 4-Chlorobenzimidazole
(7) 5,6-Dimethylbenzimidazole
(8) 5-Nitro-2-(trifluoromethyl)benzimidazole
11. Indazole Derivatives:
(1) 5-Nitroindazole
(2) 6-Nitroindazole
(3) 5-Aminoindazole
(4) 6-Aminoindazole
(5) Indazole
(6) 3-Nitroindazole
(7) 5-Nitro-3-chloroindazole
(8) 3-Chloro-5-nitroindazole
(9) 3-Carboxy-5-nitroindazole
12. Tetrazole Derivatives:
(1) 5-(4-Nitrophenyl)tetrazole
(2) 5-Phenyltetrazole
(3) 5-(3-Carboxyphenyl)tetrazole
13. Tetrazaindene Derivatives:
(1) 4-Hydroxy-6-methyl-5-nitro-1,3,3a,7-tetra-azaindene
(2) 4-Mercapto-6-methyl-5-nitro-1,3,3a,7-tetra-azaindene
14. Mercaptoaryl Derivatives:
(1) 4-Nitrothiophenol
(2) Thiophenol
(3) 2-Carboxythiophenol V represents a carbonyl group,

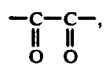

a sulfonyl group, a sulfoxy group

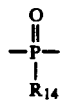

(where $R_{14}$ represents an alkoxy or aryloxy group having 1 to 30 carbon atoms), an iminomethylene group or a thiocarbonyl group, and V is preferably a carbonyl group.

The aliphatic groups represented by R are linear chain, branched or cyclic alkyl groups, linear chain, branched or cyclic alkenyl groups or alkynyl groups. Groups which have 1 to 30 carbon atoms are preferred, and those which have 1 to 20 carbon atoms are the most desirable. A branched alkyl group may be cyclized to form a saturated heterocyclic ring which contains one or more hetero atoms.

Examples of the aliphatic group include: methyl, t-butyl, n-octyl, t-octyl, cyclohexyl, hexenyl, pyrrolidyl, tetrahydrofuryl and n-dodecyl.

The aromatic groups are single ringed or double ringed aryl groups, for example phenyl and naphthyl.

The heterocyclic groups have three to ten members. They are saturated or unsaturated heterocyclic rings which contain at least one atom selected from among the N, O and S atoms. Further, they may be single ring compounds or they may form condensed with other aromatic rings or heterocyclic rings. Five or six membered aromatic heterocyclic rings are preferred, examples of which include a pyridine ring, an imidazolyl group, a quinolinyl group, a benzimidazolyl group, a pyrimidinyl group, a pyrazolyl group, an isoquinolinyl group, a benzthiazolyl group and a thiazolyl group.

R may be substituted with substituent groups. Examples of such substituent groups include: alkyl groups, aralkyl groups, alkenyl groups, alkynyl groups, alkoxy groups, aryl groups, substituted amino groups, acylamino groups, sulfonylamino groups, ureido groups, urethane groups, aryloxy groups, sulfamoyl groups, carbamoyl groups, alkylthio groups, arylthio groups, sulfonyl groups, sulfinyl groups, hydroxyl groups, halogen atoms, cyano groups, sulfo groups, aryloxycarbonyl groups, acyl groups, acyloxy groups, carbonamido groups, sulfonamido groups, carboxy groups and phosphoric acid amido groups. These substituent groups may also be substituted with substituent groups.

Furthermore, R or -(Time)$_t$-PUG in general formula (II) may have incorporated within it a ballast group of the type normally attached to immobile photographically useful additives such as couplers, and a group which promotes the adsorption of the compound represented by the general formula (II) on silver halides.

The ballast groups are organic groups which provide the compound represented by general formula (II) with sufficient molecular weight and which essentially prevent the compound from diffusing into other layers or into the processing baths. They preferably have 8 to 40 carbon atoms. Examples of the ballast groups include alkyl groups, aryl groups, heterocyclic groups, ether groups, thioether groups, amido groups, ureido groups, urethane groups and sulfonamido groups, and combinations of these groups. Ballast groups which have substituted benzene rings are preferred, and ballast groups which have benzene rings substituted with branched alkyl groups are especially preferred.

Specific examples of groups which promote adsorption on silver halides include cyclic thioamido groups such as 4-thiazolin-2-thione, 4-imidazolin-2-thione, 2-thiohydantoin, rhodanine, thiobarbituric acid, tetrazolin-5-thione, 1,2,4-triazolin-3-thione, 1,3,4-oxazolin-2-thione, benzimidazolin-2-thione, benzoxazolin-2-thione, benzothiazolin-2-thione, thiotriazine and 1,3-imidazolin-2-thione, chain-like thioamido groups, aliphatic mercapto groups, aromatic mercapto groups, heterocyclic mercapto groups (where there is a nitrogen atom adjacent to the carbon atom to which the —SH group is bonded this is the same as the cyclic thioamido group which it is related tautomerically), groups which have disulfide bonds, five or six membered nitrogen containing heterocyclic groups comprising combinations of nitrogen, oxygen, sulfur and carbon atoms (such as benzotriazole, triazole, tetrazole, indazole, benzimidazole, imidazole, benzothiazole, thiazole, thiazoline, benzoxazole, oxazole, oxazoline, thiadiazole, oxathiazole, triazine and azaindene), and heterocyclic quaternary salts (such as benzimidazolium salts).

These adsorption promoting groups may be substituted with appropriate substituent groups, such as those groups mentioned as substituent groups for R.

Specific examples of compounds of general formula (II) of the present invention are indicated below, but the invention is not limited to these examples:

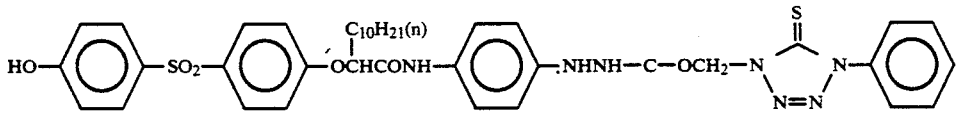

2-1

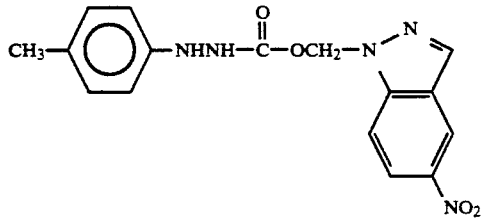

2-2

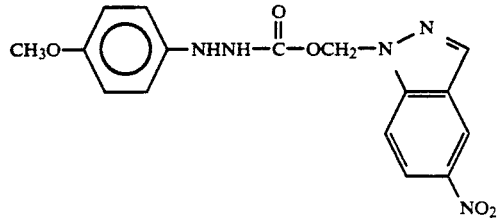

2-3

-continued
2-4
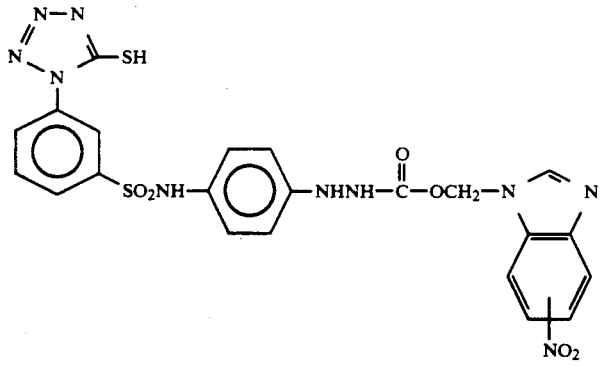
2-5
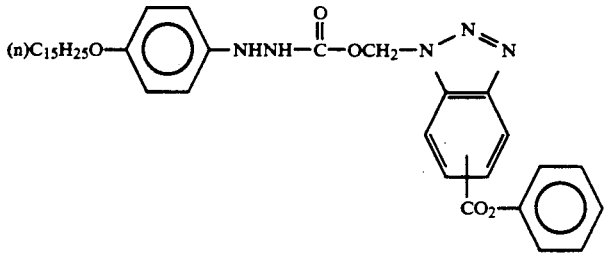
2-6
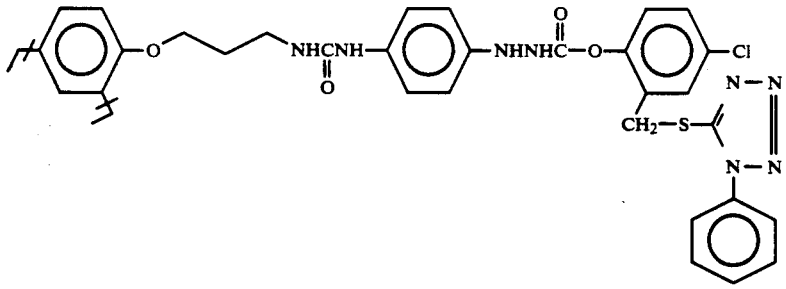
2-7
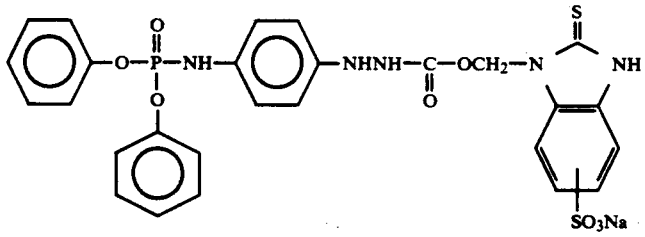
2-8
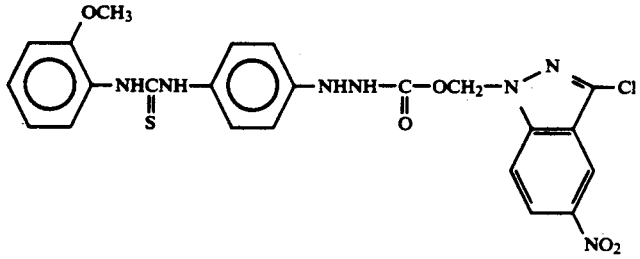
2-9
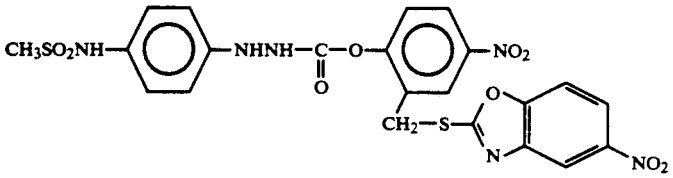

-continued
2-10
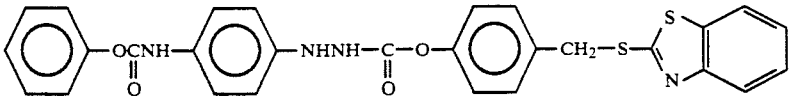
2-11
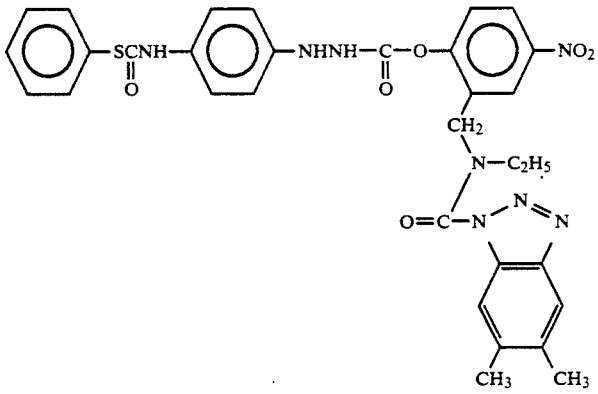
2-12
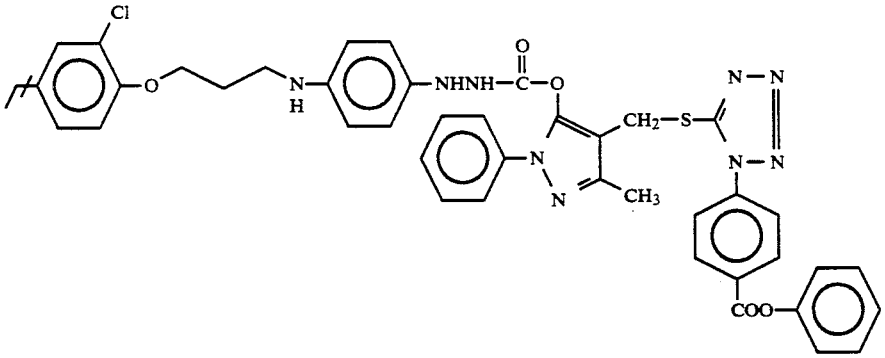
2-13
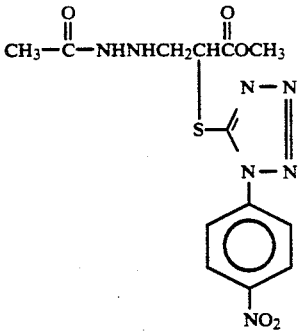
2-14
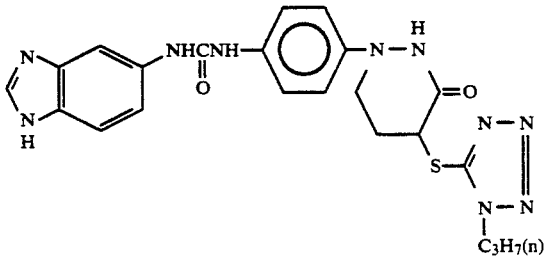

-continued
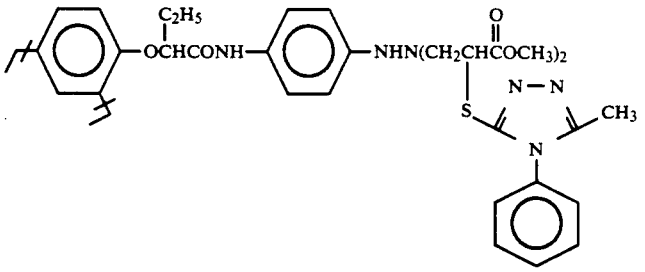
2-15
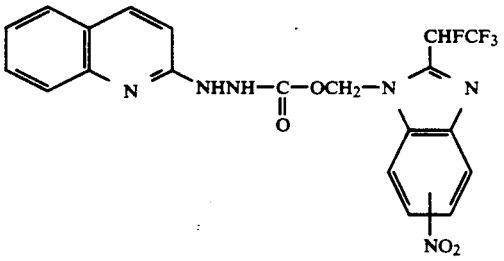
2-16
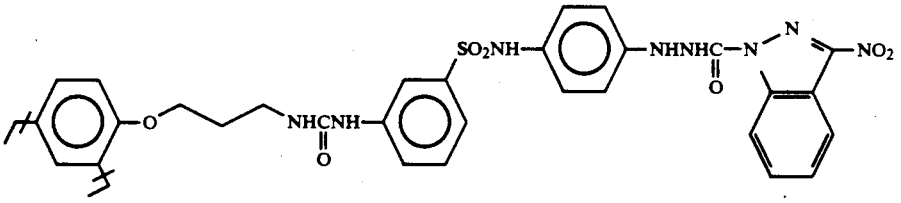
2-17
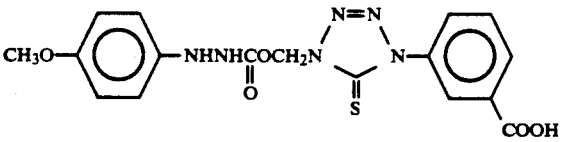
2-18
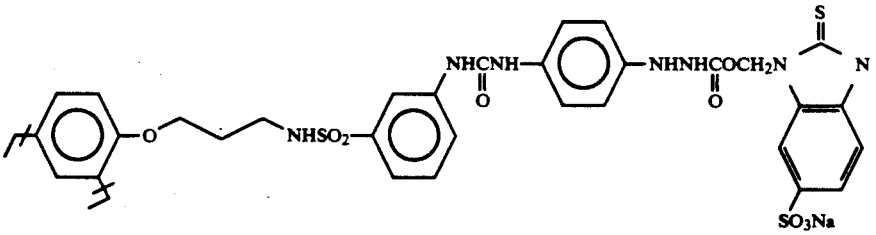
2-19
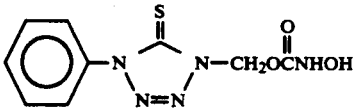
2-20
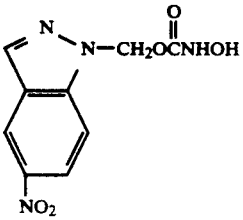
2-21

-continued
2-22
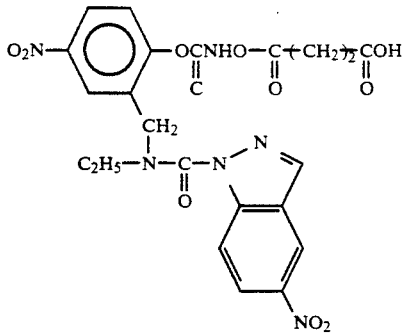
2-23
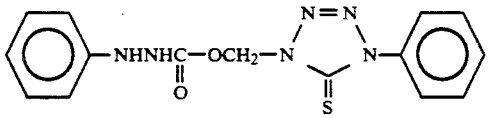
2-24
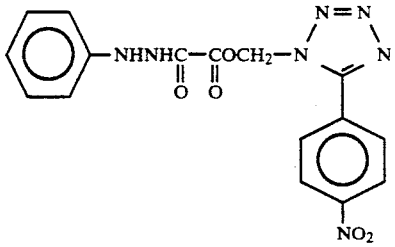
2-25
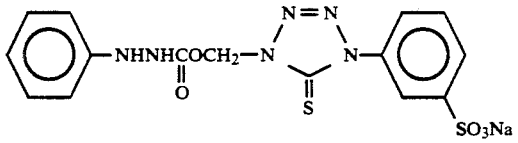
2-26
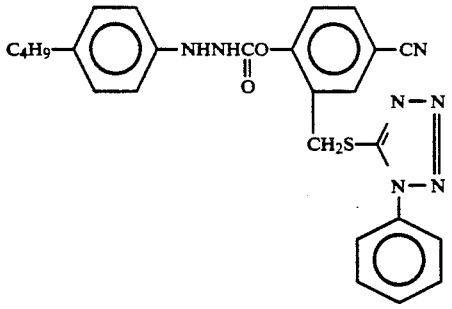
2-27
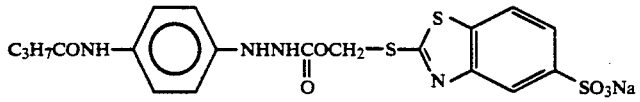
2-28
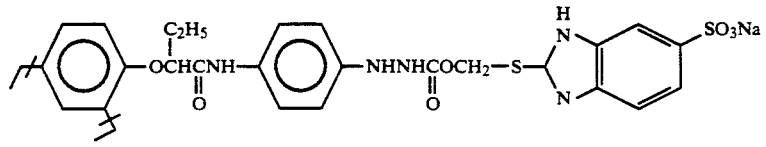

-continued
2-29
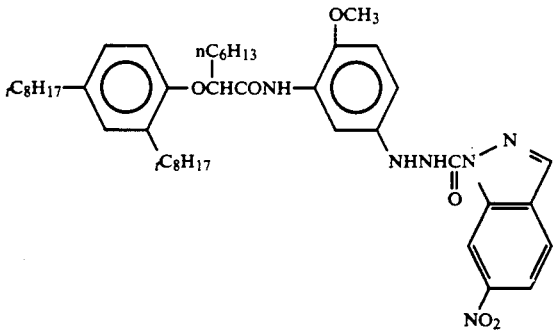
2-30
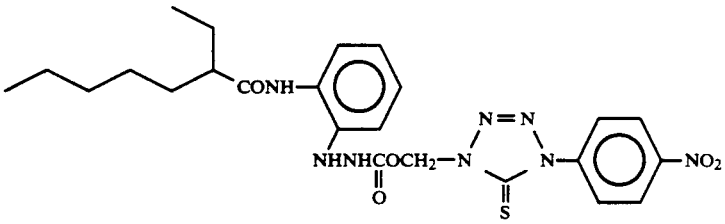
2-31
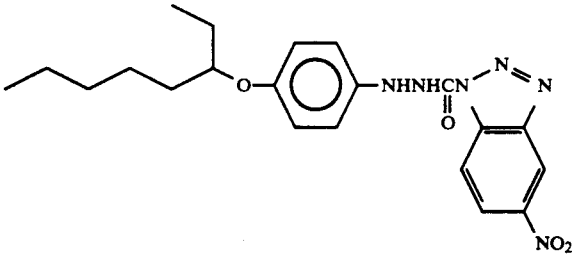
2-32
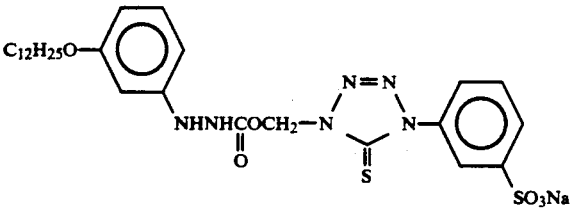
2-33
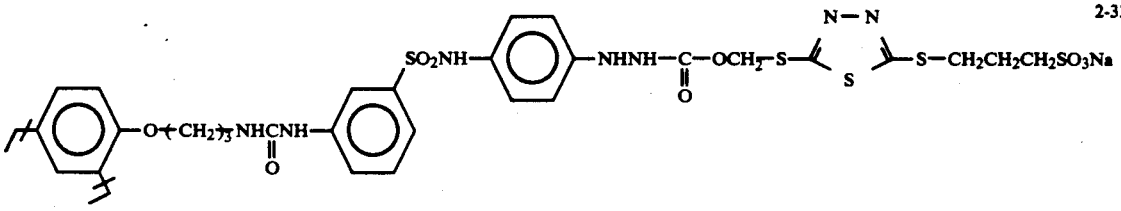
2-34
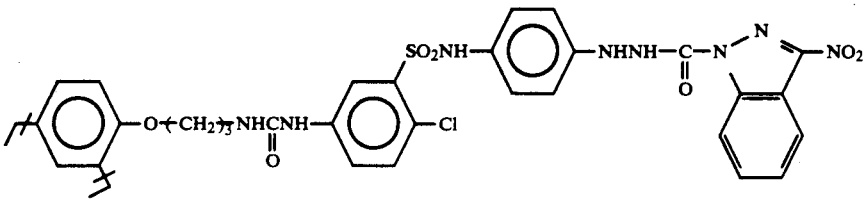

-continued
2-35
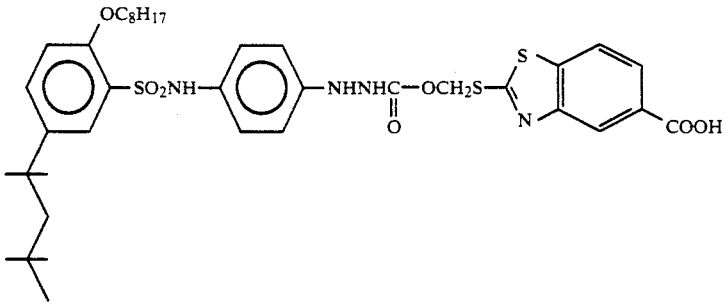
2-36
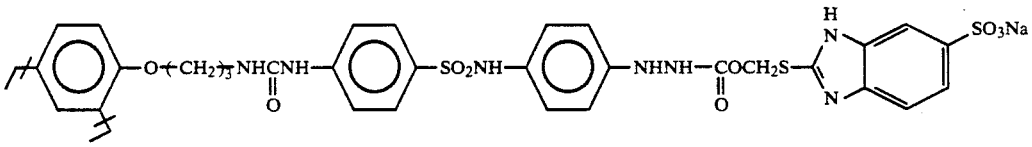
2-37
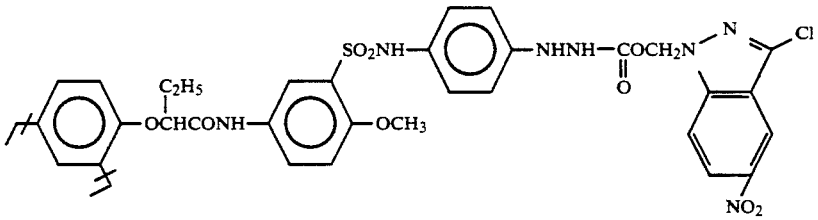
2-38
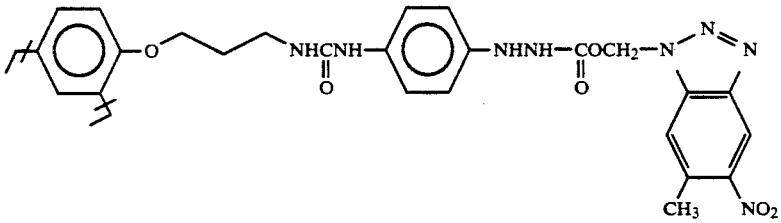
2-39
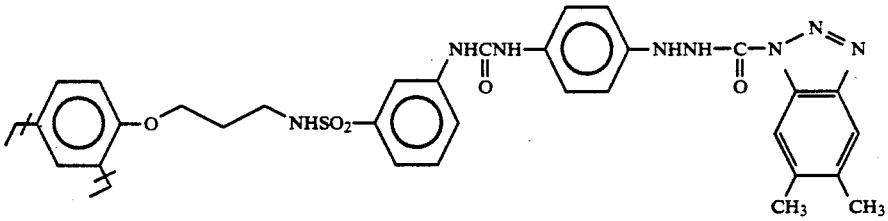
2-40
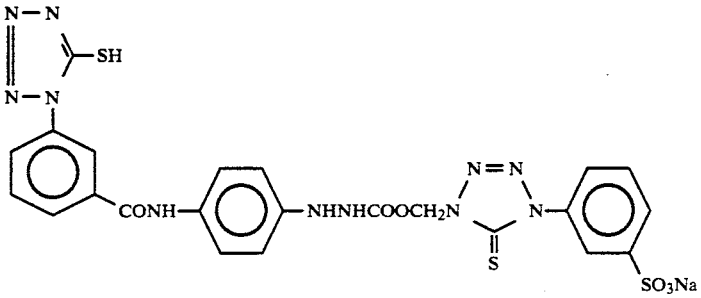

-continued
2-41
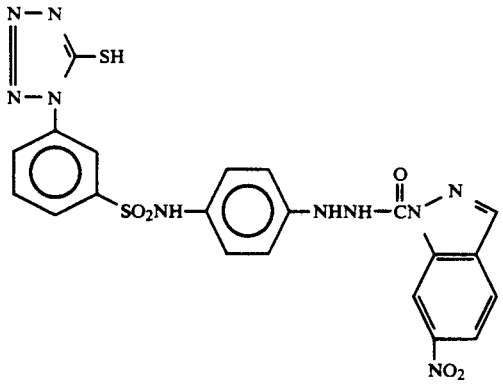
2-42
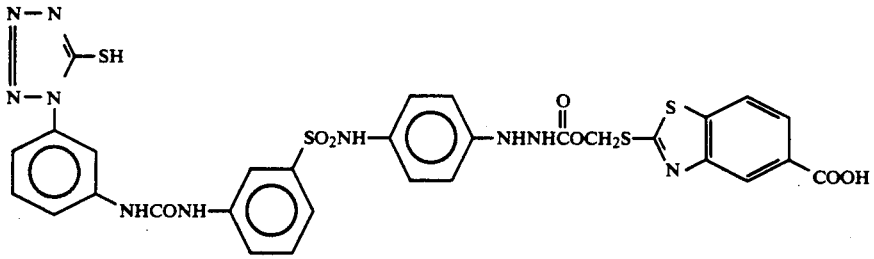
2-43
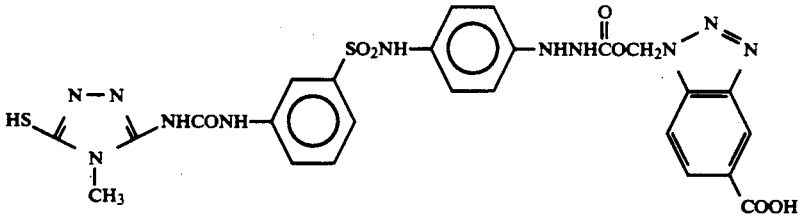
2-44
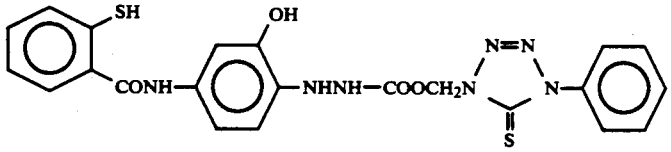
2-45
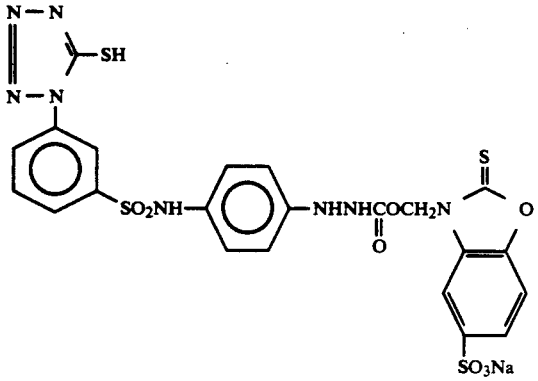

-continued
2-46
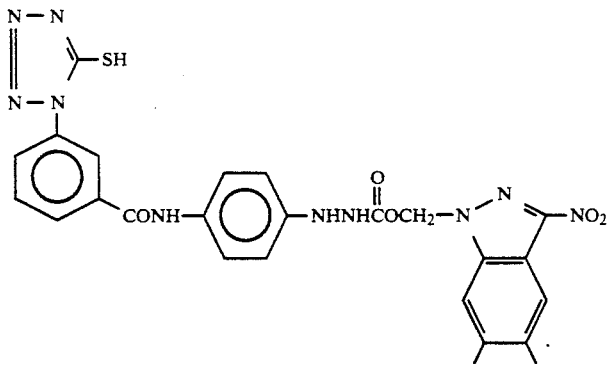
2-47
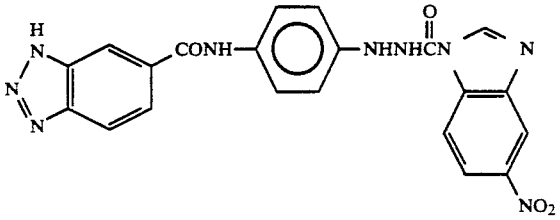
2-48
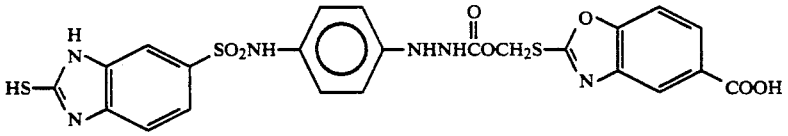
2-49
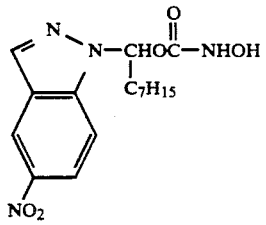
2-50
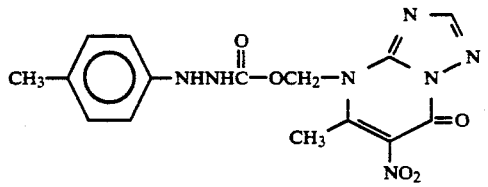
2-51
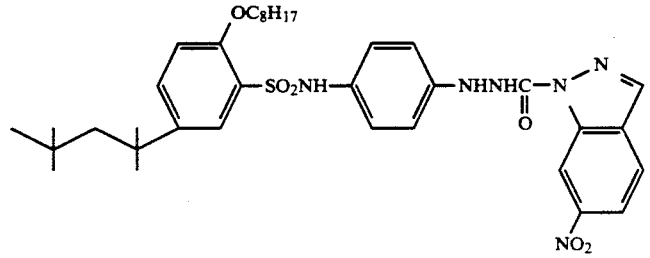

-continued
2-52
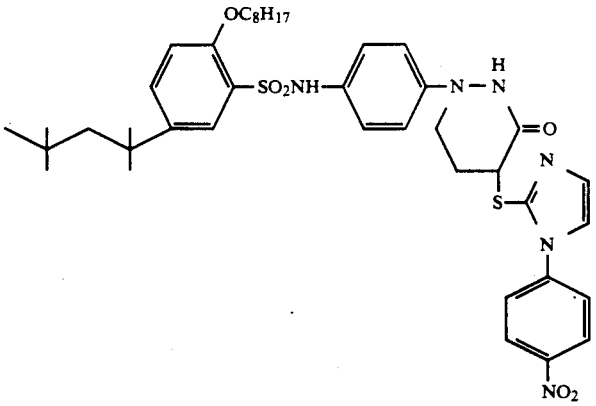
2-53
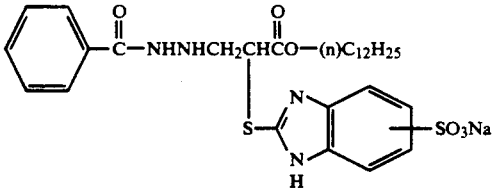
2-54
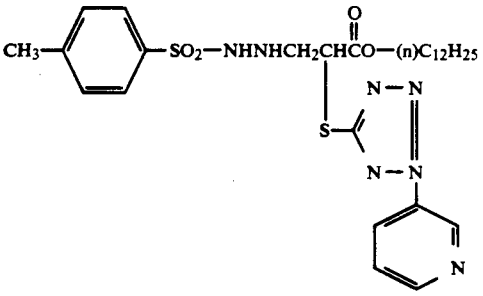
2-55
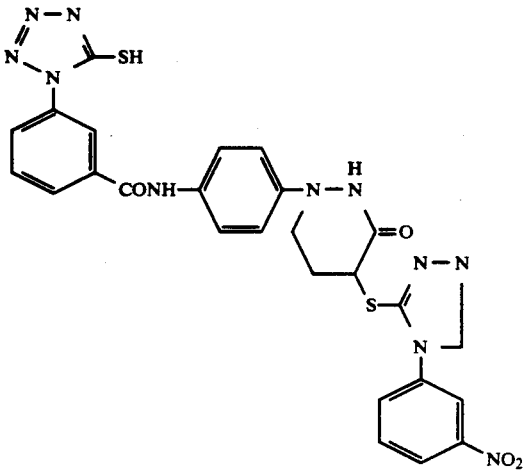

-continued
2-56
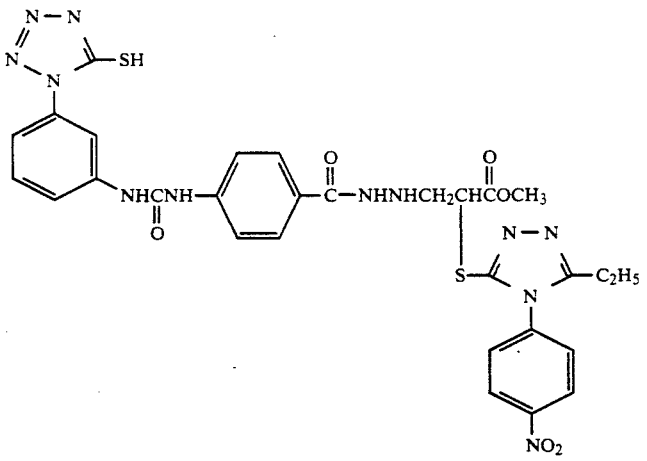
2-57
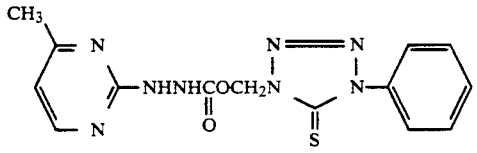
2-58
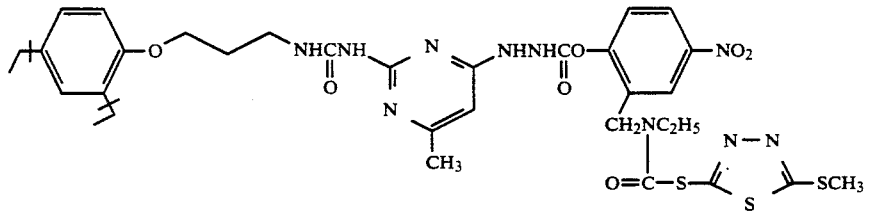
2-59
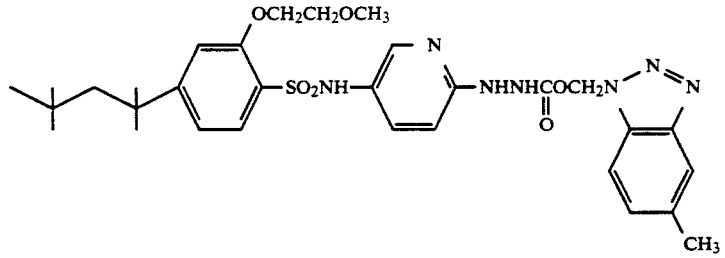
2-60
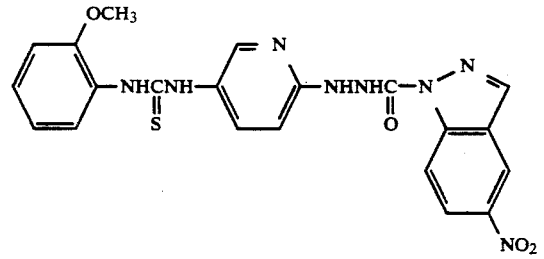
2-61
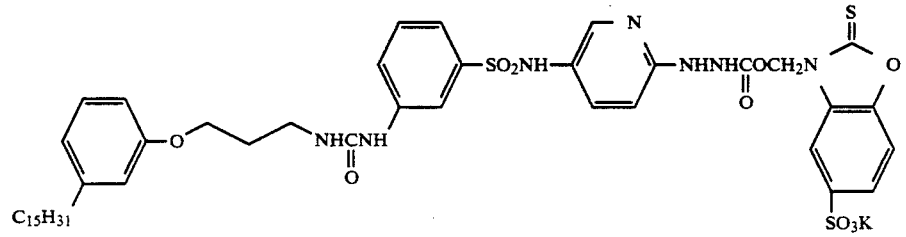

-continued 2-62

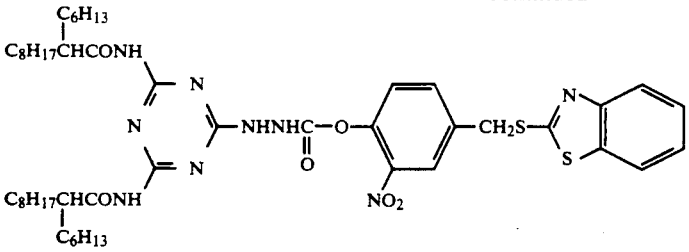

2-63

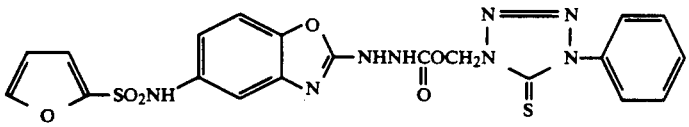

2-64

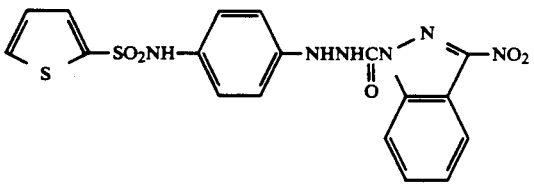

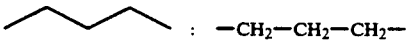

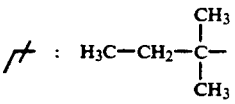

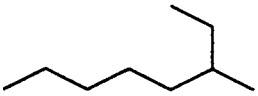

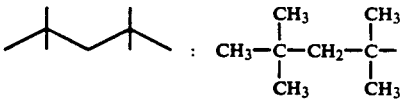

Methods for synthesizing redox compounds which can be employed in the present invention are described in JP-A-61-213847, JP-A-62-260153, U.S. Pat. No. 4,684,604, JP-A-1-269936, U.S. Pat. Nos. 3,379,529, 3,620,746, 4,377,634 and 4,332,878, JP-A-49-129436, JP-A-56-153336, JP-A-56-153342, and so on.

The redox compounds to be used in the present invention are used in an amount ranging from $1\times10^{-5}$ to $5\times10^{-2}$ mole, preferably from $2\times10^{-5}$ to $1\times10^{-2}$ mole, per mole of silver halide. In using these compounds, they can be dissolved in a proper water-miscible organic solvent, such as alcohols (e.g., methanol, ethanol, propanol, fluorinated alcohols), ketones (e.g., acetone, methyl ethyl ketone), dimethylformamide, dimethyl sulfoxide, methyl cellosolve, or the like.

On the other hand, they may be used in the form of an emulsified dispersion, which can be prepared using a well-known emulsifying dispersion method wherein a compound is dispersed in an oil, such as dibutyl phthalate, tricresyl phosphate, glyceryl triacetate, diethyl phthalate or the like, with the aid of an auxiliary solvent such as ethyl acetate, cyclohexanone or so on, and emulsified mechanically, or using a known solid dispersion method wherein a powdered redox compound is dispersed into water by means of a ball mill, a colloid mill, or ultrasonic waves. Incorporation of the compound(s) represented by the general formula (II) in a photographic emulsion layer or another hydrophilic colloid layer can be effected by dissolving it into water or a water-miscible organic solvent (if necessary, after converting it to a salt thereof by the addition of an alkali hydroxide or a tertiary amine), and then adding the resulting solution to a hydrophilic colloid solution (e.g., a silver halide emulsion, an aqueous gelatin solution). (Herein, the pH of the colloid solution may be controlled by the addition of acids or alkalies, if needed.)

The compound represented by the general formula (II) are preferably added in an amount of from $1\times10^{-6}$ mole to $5\times10^{-2}$ mole, particularly from $1\times10^{-5}$ mole to $1\times10^{-2}$ mole, per mole of silver halide.

The compounds of formula (I) of the present invention may be used alone or as a mixture of two or more thereof. They are preferably added in an amount of from $1\times10^{-6}$ mole to $5\times10^{-2}$ mole, particularly from $1\times10^{-5}$ mole to $1\times10^{-2}$ mole, per mole of silver halide, and the amount to be added can be properly selected depending on the properties of the silver halide emulsion to be used in combination.

The compounds of this invention, which are represented by the general formulae (I) and preferably (II)

respectively, can provide a negative image with high contrast by the combined use with a negative type emulsion. On the other hand, they can also be used in combination with an internal latent image type silver halide emulsion. However, the compounds represented by the general formulae (I) and (II) of this invention prefer the combined use with a negative type emulsion for the formation of a high contrasty negative image.

When the compounds are used to form high-contrast negative image, it is preferred that silver halide to be used has a mean grain size in the range of fine grains (e.g., not larger than 0.7 μm, particularly preferably not larger than 0.5 μm). Though there are basically no limitations with regard to grain size distribution, monodisperse system is preferred. The term "monodisperse" as used herein means that at least 95% (by weight or in terms of the number of grains) of gains is composed of those having a grain size within ±40% of mean grain size.

Silver halide grains in the photographic emulsions may have regular crystal form such as cube, octahedron, rhombic dodecahedron or tetradecahedron, irregular crystal form such as sphere or tabular form or a composite form of those crystal forms.

The interior and surface layer of the silver halide grain may be composed of a uniform phase or of different phases.

Cadmium salt, sulfite, lead salt, thallium salt, rhodium salt or its complex salt, or iridium salt may be allowed to coexist during the formation of silver halide grains or during physical ripening in the preparation of the silver halide emulsions of the present invention.

The silver halide emulsions of the present invention may or may not be subjected to chemical sensitization. As methods for the chemical sensitization of the silver halide emulsions, there are known sulfur sensitization, reduction sensitization and noble metal sensitization. These methods may be used either alone or in combination to carry out chemical sensitization.

A typical noble metal sensitization is the gold sensitization method using gold compounds, mainly gold complex. Noble metals such as complex salts of platinum, palladium and rhodium other than gold may be used. Examples thereof are described in U.S. Pat. No. 2,448,060 and British Patent 618,016. Various sulfur compounds such as thiosulfates, thioureas, thiazoles and rhodanine in addition to sulfur compounds contained in gelatin can be used as the sulfur sensitizing agent.

It is preferred that iridium salt or rhodium salt is used before the completion of physical ripening, particularly during the formation of grains in the preparation of the silver halide emulsions.

It is preferred from the viewpoint of elevating maximum density (Dmax) that the silver halide emulsion layers of the present invention contain two kinds of monodispersed emulsions having different mean grain sizes as is described in JP-A-61-223734 and JP-A-62-90646. It is preferred that smaller-size monodispersed rains are chemically sensitized. Sulfur sensitization is most preferred as chemical sensitization. Larger-size monodispersed grains need not be chemically sensitized. However, the grains may be chemically sensitized. Since larger-size monodispersed grains are liable to form black peppers, the grains are generally not chemically sensitized. However, when chemical sensitization of larger-size grains is carried out, it is particularly preferred that chemical sensitization is conducted only to such a slight extent that black peppers are not yet formed. The term "slight extent" as used herein means that chemical sensitization is carried out by shortening chemical sensitization time, lowering the temperature of chemical sensitization or reducing chemical sensitizing agents to be added in comparison with the chemical sensitization of smaller-size grains. Though there is no particular limitation with regard to a difference in sensitivity between a larger-size monodispersed emulsion and a smaller-size monodispersed emulsion, the difference is preferably 0.1 to 1.0, more preferably 0.2 to 0.7 in terms of ΔlogE. It is preferred that the larger-size monodispersed emulsion has higher sensitivity than that of the smaller-size monodispersed emulsion. The sensitivity of each emulsion is obtained by coating a support with the emulsion containing the hydrazine derivative and processing it with a developing solution having a pH of 10.5 to 12.3 and containing a sulfite ion at a concentration of at least 0.15 mol/l. The mean grain size of small-size monodispersed grains is not larger than 90%, preferably not larger than 80% of that of larger-size monodispersed grains. The mean grain size of silver halide emulsion grains is preferably 0.02 to 1.0 μm, more preferably 0.1 to 0.5 μm. It is preferred that the mean grain sizes of both the smaller-size and larger-size grains are in the range described above.

When two or more emulsions having different grain sizes are used in the present invention, the coating weight (in terms of silver) of the smaller-size monodispersed emulsion is preferably 40 to 90 wt%, more preferably 50 to 80 wt% based on the total coating weight of silver.

In the present invention, monodispersed emulsions having different grain sizes may be introduced into the same emulsion layer or into separate layers. When they are introduced into separate layers, it is preferred that the larger-size emulsion is introduced into the upper layer and the smaller-size emulsion is introduced into the lower layer.

The total coating weight of silver is preferably 1 $g/m^2$ to 8 $g/m^2$.

Sensitizing dyes (e.g., cyanine dyes, merocyanine dyes, etc.) described in JP A-55-52050 (pages 45 to 53) can be added to the photographic materials of the present invention to increase sensitivity. These sensitizing dyes may be used either alone or in combination. The combinations of the sensitizing dyes are often used for the purpose of supersensitization in particular. In addition to the sensitizing dyes, emulsions may contain a dye which itself does not have a spectral sensitization effect, or a material which does not substantially absorb visible light but does exhibit supersensitizing activity. Useful sensitizing dyes, combinations of dyes for the purpose of supersensitization and materials exhibiting supersensitization are described in *Research Disclosure,* Vol. 176, No. 17643 (December, 1978), page 23, item IV-J.

The photographic materials may contain various compounds to prevent fogging from being caused during the manufacturing process and during storage of the photographic materials or during processing or to stabilize photographic performance. Namely, compounds known as antifogging agents or stabilizers such as azoles, for example, benzthiazolium salts, nitroindazoles, chlorobenzimidazoles, bromobenzimidazoles, mercaptothiazoles, mercaptobenzthiazoles, mercaptothiadiazoles, aminotriazoles, benzthiazoles and nitrobenzotriazoles; mercaptopyrimidines; mercaptotriazines; thioketo compounds, for example, oxazolinethione; azaindenes, for example, triazaindenes, tetraazaindenes (particularly, 4-hydroxysubstituted-(1,3,3a,7)tetraazaindenes); pentaazaindenes; and benzenethiosulfonic acid and benzenesulfinic acid benzenesulfonamide can be added. Among them, benzotriazoles (e.g., 5-methyl benzotriazole) and nitroindazoles (e.g., 5-nitroindazole) are preferred. Alternatively, these compounds may be incorporated in processing solutions.

As development accelerators or accelerators for nucleating infectious development in the present invention, compounds described in JP-A-53-77616, JP-A-54-37732, JP-A-53-137133, JP-A-60-140340 and JP-A-60-14959 and nitrogen- or sulfur-containing compounds can be effectively used.

The optimum amount of these accelerators varies depending on the type of compound, but they are generally used in an amount of $1.0\times10^{-3}$ to 0.5 g/m$^2$, preferably $5.0\times10^{-3}$ to 0.1 g/m$^2$.

The photographic emulsion layers and other hydrophilic colloid layers of the photographic material of the present invention may contain desensitizers.

Organic desensitizers used in the present invention are determined by polarographic half wave potential, (namely, oxidation-reduction potential determined by polarography) and are those wherein the sum of the polarographic anode potential and cathode potential is positive. A method for measuring oxidation-reduction potential by polarography is described in, for example, U.S. Pat. No. 3,501,307. It is preferred that the organic desensitizers have at least one water-soluble group such as a sulfonic acid group or a carboxyl group. These groups may form a salt with an organic base (e.g., ammonia, pyridine, triethylamine, piperidine, morpholine, etc.) or an alkali metal (e.g., sodium, potassium, etc.).

Preferable organic desensitizers used in the present invention include compounds represented by the following formulae (IV) to (VI):

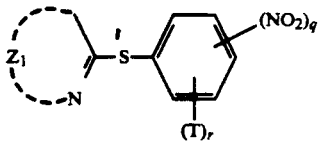

(IV)

wherein T represents an alkyl group, a cycloalkyl group, an alkenyl group, a halogen atom, a cyano group, a trifluoromethyl group, an alkoxy group, an aryloxy group, a hydroxy group, an alkoxycarbonyl group, a carboxyl group, a carbamoyl group, a sulfamoyl group, an aryl group, an acylamino group, a sulfonamido group, a sulfo group or a benzocondensed ring, which may or may not have one or more substituents; $Z_1$ represents a group of nonmetal atoms required to complete a nitrogen-containing heterocyclic ring, which may or may not have one or more substituents; q is 1, 2 or 3; and r is 0, 1 or 2.

Specific examples of nitrogen-containing heterocyclic rings completed through $Z_1$ include a 1,2,4-triazole ring, a 1,3,4-oxadiazole ring, a 1,3,4-thiadiazole ring, a tetraazaindene ring, a pentaazaindene ring, a triazaindene ring, a benzothiazole ring, a benzimidazole ring, a benzoxazole ring, a pyrimidine ring, a triazine ring, a pyridine ring, a quinoline ring, a quinazoline ring, a phthalazine ring, a quinoxaline ring, an imidazo[4,5-b]quinoxaline ring, a tetrazole ring and a 1,3-diazaazulene ring, which may or may not have one or more substituents or may be fused with one or more additional aromatic rings.

Formula (V) is as follows:

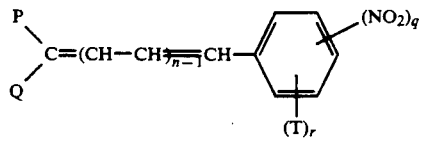

(V)

wherein P and Q, which may be the same or different, each represents a cyano group, an acyl group, a thioacyl group, an alkoxycarbonyl group, an alkylsulfonyl group, an arylsulfonyl group, a substituted or unsubstituted sulfamoyl group, a substituted or unsubstituted carbamoyl group, a nitro group, or a substituted or unsubstituted aryl group; n is 1, 2 or 3; and T, r and q have the same meaning as defined in formula (IV) above; and formula (VI) is as follows:

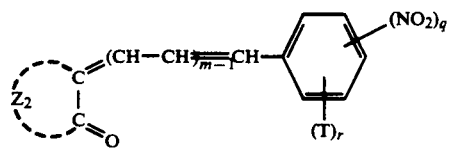

(VI)

wherein $Z_2$ represents a group of nonmetal atoms required to complete a ketomethylene ring; m is 1, 2 or 3; and T, r and q have the same meaning as defined in formula (IV) above.

Specific examples of ketomethylene rings completed through $Z_2$ include a pyrazolone ring, an isoxazolone ring, an oxindol ring, a barbituric ring, a thiobarbituric ring, a rhodanine ring, an imidazo[1,2-a]pyridone ring, a 2-thio-2,4-oxazolidinedione ring, a 2-thio-2,5-thiazolidinedione ring, a thiazolidone ring, a 4-thiazolone ring, a 2-imino-2,4-oxazolinone ring, a 2,4-imidazolinedione ring (a hydantoin ring), a 2-thiohydantoin ring and a 5-imidazolone ring., The organic desensitizers are allowed to exist in an amount of $1.0\times10^{-8}$ to $1.0\times10^{-4}$ mol/m$^2$, particularly preferably $1.0\times10^{-7}$ to $1.0\times10^{-5}$ mol/m$^2$, in the silver halide emulsion of the present invention.

The emulsion layers and other hydrophilic colloid layers of the present invention may contain water-soluble dyes as filter dyes or for the purposes of irradiation prevention, etc. As the filter dyes, there are used dyes for lowering photographic sensitivity, preferably ultraviolet absorbers having a spectral absorption maximum in the region of sensitivity inherent in silver halide or dyes having light absorption in the region of mainly 380 nm to 600 nm to enhance safety to safelight in handling the photographic material as a daylight material.

Preferably, these dyes are added to the emulsion layers, or these dyes together with a mordant are added to the area above the silver halide emulsion layers. In other words, the dyes and the mordant are added to the light-insensitive hydrophilic colloid layer which is farther away from the support than the silver halide emulsion layer. After such addition the dyes are fixed.

The amounts of the dyes to be used vary depending on the molar absorption coefficient of the ultraviolet light absorber, but the dyes are generally used in an amount of $10^{-2}$ to 1 g/m$^2$, preferably 50 to 500 mg/m$^2$.

The above-described ultraviolet light absorbers are dissolved in an appropriate solvent [e.g., water, alcohol (e.g., methanol, ethanol, propanol, etc.), acetone, methyl cellosolve, etc. or a mixture thereof] and are then added to coating solutions.

As the ultraviolet light absorbers, there can be used aryl group-substituted benzotriazole compounds, 4-thiazolidone compounds, benzophenone compounds, cinnamic ester compounds, butadiene compounds, benzoxazole compounds and ultraviolet light absorbing polymers.

Examples of the ultraviolet light absorbers are described in U.S. Pat. Nos. 3,533,794, 3,314,794 and 3,352,681, JP-A-46-2784, U.S. Pat. Nos. 3,705,805, 3,707,375, 4,045,229, 3,700,455 and 3,499,762 and West German Patent Publication No. 1,547,863.

Examples of the filter dyes include oxonol dyes, hemioxonol dyes, styryl dyes, merocyanine dyes, cyanine dyes and azo dyes. Water-soluble dyes or dyes which can be decolorized by alkalies or sulfite ions are preferred from the viewpoint of reducing the formation of aftercolor after developing.

Examples of the dyes include pyrazolone oxonol dyes described in U.S. Pat. No. 2,274,782; diaryl azo dyes described in U.S. Pat. No. 2,956,879; styryl dyes and butadiene dyes described in U.S. Pat. Nos. 3,423,207 and 3,384,487; merocyanine dyes described in U.S. Pat. No. 2,527,583; merocyanine dyes and oxonol dyes described in U.S. Pat. Nos. 3,486,897, 3,652,284 and 3,718,472; enaminohemioxonol dyes described in U.S. Pat. No. 3,976,661; and dyes described in British Patents 584,609 and 1,177,429, JP-A-48-85130, JP-A-49-99620, JP-A-49-114420, U.S. Pat. Nos. 2,533,472, 3,148,187, 3,177,078, 3,247,127, 3,540,887, 3,575,704 and 3,653,905.

The dyes are dissolved in an appropriate solvent [e.g., water, alcohol (e.g., methanol, ethanol, propanol, etc.), acetone, methyl cellosolve, etc. or a mixture thereof] and are then added to coating solutions for the light-insensitive hydrophilic colloid layers of the present invention.

Specifically, the dyes are used in an amount of generally $10^{-3}$ to 1 g/m$^2$, particularly preferably $10^{-3}$ to 0.5 g/m$^2$.

The photographic emulsion layers and other hydrophilic colloid layers of the photographic material of the present invention may contain inorganic or organic hardening agents such as chromium salts, aldehydes (e.g., formaldehyde, glutaraldehyde, etc.), N-methylol compounds (e.g., dimethylol urea), active vinyl compounds (e.g., 1,3,5-triacryloyl-hexahydro-s-triazine, 1,3-vinylsulfonyl-2-propanol), active halogen compounds (e.g., 2,4-dichloro-6-hydroxy-s-triazine), mucohalogen acids, etc. These compounds may be used either alone or in combination.

The photographic emulsion layers or other hydrophilic colloid layers of the photographic material of the present invention may contain surfactants as a coating aid or to impart antistatic properties, improve sliding properties and emulsified dispersion, prevent adhesion or improve photographic characteristics (e.g., development acceleration, sensitization and high contrast). Particularly preferred examples of surfactants which can be used in the present invention are polyalkylene oxides having a molecular weight of not less than 600 which are described in JP-B-58-9412 (the term "JP-B" as used herein means an "examined Japanese patent publication"). When the surfactants are to be used as antistatic agents, fluorine-containing surfactants (in detail described in U.S. Pat. No. 4,201,586, JP-A-60-80849, JP-A-59-74554) are particularly preferred.

The photographic emulsion layers and other hydrophilic colloid layers of the photographic material of the present invention may contain a matting agent such as silica, magnesium oxide or polymethyl methacrylate to prevent adhesion.

The photographic emulsions of the present invention may contain a dispersion of a water-insoluble or sparingly water-soluble synthetic polymer to improve dimensional stability. For this purpose, there can be used, for example, polymers of alkyl (meth)acrylates, alkoxyalkyl (meth)acrylates, glycidyl (meth)acrylates, etc., singly or a mixture thereof, or copolymers thereof with a monomer component such as acrylic acid or methacrylic acid.

It is preferred to inhibit the occurrence of black pepper fog that the silver halide emulsion layers and other layers of the photographic material of the present invention contain a compound having an acid group. Examples of compounds having an acid group include organic acids such as salicylic acid, acetic acid and ascorbic acid and polymers having a repeating unit of an acid monomer such as acrylic acid, maleic acid, phthalic acid or the like or copolymers of these monomers. These compounds are described in JP-A-61-223 834, JP-A-61-228437, JP-A-62-25745 and JP-A-62-55642. Among them, a particularly preferred low-molecular compound is ascorbic acid. There are particularly preferred water-dispersible latexes of copolymers of an acid monomer such as acrylic acid with a cross-linking monomer having two or more unsaturated groups such as divinyl benzene as high-molecular weight compounds.

Stable developing solutions can be used to obtain superhigh-contrast, high-sensitivity photographic characteristics by using the silver halide photographic material of the present invention without using conventional infectious developing solutions or highly alkaline developing solutions having a pH near 13 as described in U.S. Pat. No. 2,419,975.

The silver halide photographic materials of the present invention give sufficiently superhigh-contrast negative images by using developing solutions having a pH of 10.5 to 12.3, particularly 11.0 to 12.0 and containing a sulfite ion as preservative at a concentration of not less than 0.15 mol/l.

Though there are no particular limitations with respect to developing agents used in the developing solutions of the present invention, it is preferred from the viewpoint of easily obtaining halftone dots of good quality that dihydroxybenzenes are present. Combinations of dihydroxybenzenes and 1-phenyl-3-pyrazolidones or combinations of dihydroxybenzenes and p-aminophenols may also be used. The developing agents are used in an amount of preferably 0.05 to 0.8 mol/l. When combinations of dihydroxybenzenes and 1-phenyl-3-pyrazolidones or p-aminophenols are used, the former is used in an amount of 0.05 to 0.5 mol/l and the latter is used in an amount of preferably not more than 0.06 mol/l.

Sulfite preservatives which are used in the present invention include sodium sulfite, potassium sulfite, lithium sulfite, ammonium sulfite, sodium bisulfite, potassium metabisulfite and formaldehydesodium bisulfite. The sulfites are used in an amount of not less than 0.4 mol/l, particularly preferably not less than 0.5 mol/l.

Compounds described in JP-A-56-24347 can be used as silver stain inhibitors in the developing solutions of the present invention. Compounds described in JP-A-61-267759 can be used as dissolution aids to be added to the developing solutions. Compounds described in JP-A-60-93433 or JP-A-62-186259 can be used as pH buffer agents to be used for the developing solutions.

Specific examples of the silver stain inhibitors are as follows.

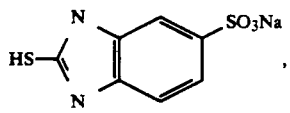

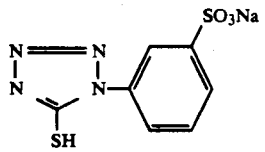

Specific examples of the dissolution aid include p-toluene sulphonic acid sodium salt, and specific examples of the pH buffer agents include borate, 5-sulfosalicylic acid and phosphate.

The compounds of formula (I) can be used in combination with negative type emulsions to give high-contrast photographic materials as described above. In addition thereto, the compounds can be used in combination with internal latent image type silver halide emulsions. Embodiments therefor are illustrated below. It is preferred that the compounds having the formula (I) are incorporated in the internal latent image type silver halide emulsion layers. However, the compounds may be incorporated in hydrophilic colloid layers adjacent to the internal latent image type silver halide emulsion layers. Such layers include a coloring material layer, an interlayer, a filter layer, a protective layer and an antihalation layer. The layers may be those having any function, so long as interference with the diffusion of the nucleating agents in silver halide grains does not occur.

It is desirable that the contents of the compounds having the formula (I) in the layers are in an amount to give sufficient maximum density (e.g., at least 1.0 in terms of silver density) when the internal latent image type emulsions are developed with surface developing solutions. Practically, the contents vary depending on the characteristics of the silver halide emulsions to be used, the chemical structures of the nucleating agents and developing conditions. Hence, suitable contents vary widely, but the contents of the compounds are practically in the range of about 0.005 mg to 500 mg per mol of silver in the internal latent image type silver halide emulsion, preferably in the range of about 0.01 mg to about 100 mg per mol of silver. When the compounds are to be incorporated in the hydrophilic colloid layers adjacent to the emulsion layers, the same amount as that described above in connection with the amount of silver contained in the same area as that of the internal latent image type emulsion layer may be incorporated. The definition of the internal latent image type silver halide emulsion is described in JP-A-61-170733 (page 10, upper column) and British Patent 2,089,057 (pages 18 to 20).

Preferred internal latent image type emulsions which can be used in the present invention are described in JP-A-63-108336 (page 28, line 14 to page 31, line 2) which corresponds to European Patent Application 267482A and preferred silver halide grains are described in JP-A-63-108336 (page 31, line 3 to page 32, line 11).

The internal latent image type emulsions of the photographic material of the present invention may be spectral-sensitized to relatively long-wave blue light, green light, red light or infrared light by using sensitizing dyes. Examples of the sensitizing dyes which can be used include cyanine dyes, merocyanine dyes, complex cyanine dyes, complex merocyanine dyes, holopolar cyanine dyes, styryl dyes, hemicyanine dyes, oxonol dyes and hemioxonol dyes. Cyanine dyes and merocyanine dyes described in JP-A-59-40638, JP-A-59-636 and JP-A-59-38739 are included in these sensitizing dyes.

Dye image forming couplers can be incorporated as coloring materials in the photographic material of the present invention. Alternatively, development may be carried out with developing solutions containing dye image forming couplers.

Examples of cyan, magenta and yellow couplers which can be used in the present invention are described in patents cited in *Research Disclosure* (RD), No. 17643 (December, 1978), item VII-D and ibid., No. 18717 (November, 1979).

There can be used couplers giving color forming dyes which are properly diffusing, non-color forming couplers, DIR couplers releasing a development restrainer by a coupling reaction, and couplers releasing a development accelerator.

Typical examples of yellow couplers which can be used in the present invention are the oil protect type acylacetamide couplers.

Two equivalent type yellow couplers are preferably used in the present invention. Typical examples thereof are the oxygen atom elimination type yellow couplers and the nitrogen atom elimination type yellow couplers. α-Pivaloylacetanilide couplers give color dyes which are excellent in fastness, particularly fastness to light, and α-benzoylacetanilide couplers give high color density.

Examples of magenta couplers which can be used in the present invention include oil protect type indazolone couplers, cyanoacetyl couplers, and preferably 5-pyrazolone couplers and pyrazoloazole couplers such as pyrazolotriazole. 5-Pyrazolone couplers having an arylamino group or an acylamino group at the 3-position are preferred from the viewpoint of the hue and color density of the color forming dyes. Nitrogen atom elimination groups described in U.S. Pat. No. 4,310,619 and arylthio groups described in U.S. Pat. No. 4,351,897 are preferred as the elimination groups of two equivalent type 5-pyrazolone couplers. 5-Pyrazolone couplers having a ballast group described in European Patent 73,636 give high color density.

Examples of the pyrazoloazole couplers include pyrazolobenzimidazoles described in U.S. Pat. No. 3,379,899, preferably pyrazolo[5,1-c][1,2,4]triazoles described in U.S. Pat. No. 3,725,067, pyrazolotetrazoles described in *Research Disclosure*, No. 24220 (June, 1984) and pyrazolopyrazoles described in *Research Disclosure*, No. 24230 (June, 1984). Imidazo[1,2-b]pyrazoles described in European Patent 119,741 are preferred from the viewpoint of fastness to light and less secondary absorption of yellow of formed color dyes, and pyrazolo[1,5-b][1,2,4]triazole described in European Patent 119,860 is particularly preferred.

Cyan couplers which can be used in the present invention include oil protect type naphthol couplers and phenol couplers. Typical examples of the naphthol couplers include naphthol couplers described in U.S. Pat. No. 2,474,293 and preferably oxygen atom elimination type two equivalent type naphthol couplers described in U.S. Pat. Nos. 4,052,212, 4,146,396, 4,228,233 and 4,296,200. Examples of the phenol couplers include those described in U.S. Pat. Nos. 2,369,929, 2,801,171, 2,772,162 and 2,895,826. Cyan couplers having fastness to moisture and heat are preferably used in the present invention. Typical examples thereof include phenol cyan couplers having an ethyl group or a higher alkyl group at the meta-position of the phenol nucleus, 2,5-diacylamino-substituted phenol couplers and phenol couplers having a phenylureido group at the 2-position and acylamino group at the 5-position described in U.S. Pat. No. 3,772,002.

It is preferred that colored couplers in combination with the above couplers are used in color photographic materials for photographing to correct unnecessary absorption in the region of short wave for dyes formed from magenta and cyan couplers.

Couplers giving color dyes which are properly diffusing can be used to improve graininess. Such dye-diffusing couplers include magenta couplers described in U.S. Pat. No. 4,366,237 and British Patent 2,125,570 and yellow, magenta or cyan couplers described in European Patent 96,570 and West German Patent Application (OPI) No. 3,234,533.

The dye forming couplers and the above-described specific couplers may be in the form of a dimer or higher polymer. Typical examples of the dye forming polymer couplers are described in U.S. Pat. Nos. 3,451,820 and 4,080,211. Examples of magenta polymer couplers are described in British Patent 2,102,173 and U.S. Pat. No. 4,367,282.

Various kinds of couplers which are used in the present invention may be used in such a manner that two or more kinds of couplers in combination may be used for the same layer of the photographic layers, or the same compound may be introduced into two or more different layers to meet requirements of characteristics required for the photographic materials.

The color couplers are generally used in an amount of 0.001 to 1 mol per mol of sensitive silver halide. Yellow couplers are used in an amount of 0.01 to 0.5 mol, magenta couplers are used in an amount of 0.003 to 0.3 mol, and cyan couplers are used in an amount of 0.002 to 0.3 mol.

In the present invention, developing agents such as hydroxybenzenes (e.g., hydroquinone), aminophenols and 3-pyrazolidones may be incorporated in emulsions or photographic materials.

Photographic emulsions which are used in the present invention can be used in combination with dye image donating compounds (coloring materials) for color diffusion transfer process, said compounds releasing diffusing dye corresponding to the development of silver halide, to obtain a desired transferred image on an image receiving layer after appropriate development processing. Many coloring materials for color diffusion transfer process are known. Among them, there are preferred coloring materials (hereinafter referred to as DRR compound) which are initially nondiffusing, but are cleaved by the oxidation-reduction reaction with the oxidation products of developing agents (or electron transfer agents) to release diffusing dyes. Among them, DRR compounds having N-substituted sulfamoyl group are preferred. Particularly preferred DRR compounds suitable for use in combination with the nucleating agents of the present invention are the DRR compounds having α-hydroxyarylsulfamoyl group described in U.S. Pat. Nos. 4,055,428, 4,053,312 and 4,336,322 and the DRR compounds having redox parent nucleus described in JP-A-53-149328. When used in combination with such DRR compounds, temperature dependence during processing in particular is remarkably low.

It is preferred that after the internal latent image type photographic material of the present invention is imagewise exposed, a direct positive color image is formed by (1) carrying out color development with surface developing solutions having a pH of not higher than 11.5 and containing aromatic primary amine color developing agents and (2) conducting bleaching-fixing treatment after or while fogging treatment is carried out by light or nucleating agents. It is more preferred that the pH of the developing solutions is in the range of 11.0 to 10.0.

The fogging treatment of the present invention may be carried out by a so-called light fogging method wherein a second exposure is applied to the whole surface of light-sensitive layer or by a so-called chemical fogging method wherein development is carried out in the presence of a nucleating agent. If desired, development may be conducted in the presence of a nucleating agent and fogging light, or a photographic material containing a nucleating agent may be subjected to fogging exposure.

The light fogging method is described in the aforesaid JP-A-63-108336 (page 47 line 4 to page 49 line 5). Nucleating agents which can be used in the present invention are described in JP-A-63-108336 (page 49 line 6 to page 67 line 2). The compounds represented by the formulas [N-1] and [N-2] are particularly preferred. Preferred examples of these compounds are the following compounds.

(N-I-1): 6-ethoxy-2-methyl-1-propargylquinolinium bromide (N-I-2): 2,4-dimethyl-1-propargylquinolinium bromide (N-I-3): 2-methyl-1-{3-[2-(4-methylphenyl)hydrazono]-butyl}quinolinium iodide (N-I-4): 3,4-dimethyl-dihydropyrido[2,1-b]benzothiazolium bromide (N-I-5): 6-ethoxythiocarbonylamino-2-methyl-1-propargyl-quinolinium trifluoromethanesulfonate (N-I-6): 2-methyl-6-(3-phenylthioureido)-1-propargylquinolium bromide (N-I-7): 6-(5-benzotriazolocarboxyamido)-2-methyl-1-propargylquinolinium trifluoromethanesulfonate (N-I-8): 6-[3-(2-mercaptoethyl)ureido]-2-methyl-1-propargylquinolinium trifluoromethanesulfonate (N-I-9): 6-{3-[3-(5-mercapto-thiadiazolo-2-ylthio)-propyl]-ureido-2-methyl-1-propargylquinolinium}trifluoromethanesulfonate (N-I-10): 6-(5-mercaptotetrazolo-1-yl)-2-methyl-1-propargylquinolinium iodide (N-II-1): 1-formyl-2-{4-[3-(2-methoxyphenyl)ureido]-phenyl}hydrazine (N-II-2): 1-formyl-2{4-[3-{3-[3-(2,4-di-tert-pentylphenoxy)propyl]ureido}phenylsulfonylamino]-phenyl}hydrazine (N-II-3): 1-formyl-2-{4-[3-(5-mercaptotetrazolo-1-yl)-benzamido]phenyl}hydrazine (N-II-4): 1-formyl-2-[4-{3-[3-(5-mercaptotetrazolo-1-yl)-phenyl]ureido}phenyl]hydrazine (N-II-5): 1-formyl-2-[4-{3-[N-(5-mercapto-4-methyl-1,2,4-triazolo-3-yl)carbamamoyl]propaneamido}-phenyl]-hydrazine (N-II-6): 1-formyl-2-{4-[3-{N-[4-(3-mercapto-1,2,4-triazolo-4-yl)phenyl]carbamoyl}propaneamido] phenyl}hydrazine (N-II-7): 1-formyl-2-[4-{3-[N-(5-mercapto-1,3,4-thiadiazolo-2-yl)carbamoyl]propaneamido}-phenyl]-hydrazine (N-II-8): 2-[4-(benzotriazolo-5-carboxamido)-phenyl]-1-formylhydrazine (N-II-9): 2-[4-{3-[N-benzotriazolo-5-carboxamido)-carbamoyl]propaneamido}phenyl]-1-formyl-hydrazine (N-II-10): 1-formyl-2-{4-[1-(N-phenylcarbamoyl)-thiosemi-carbazido]phenyl}hydrazine (N-II-11): 1-formyl-2-{4-[3-(phenylthioureido)-benzamido]-phenyl}hydrazine (N-II-12): 1-formyl-2-[4-{3-hexylureido)phenyl]-hydrazine Nucleation accelerators which can be used in the present invention are described in JP-A-63-108336 (page 68, line 11 to page 71, line 3). Preferred examples thereof are the compounds represented by (A-1) to (A-13) described in JP-A-63-108336 (pages 69 to 70).

Color developing solutions which can be used in the development of the photographic material of the present invention are described in JP-A-63-108336 (page 71, line 4 to page 72, line 9). Particularly preferred examples of aromatic primary amine color developing agents include p-phenylenediamine compounds. Typical examples thereof include 3-methyl-4-amino-N-ethyl-N-(β-methanesulfonamidoethyl)aniline, 3-methyl-4-amino-N-ethyl-N-(β-hydroxyethyl)aniline, 3-methyl-4-amino-N-ethyl-N-methoxyethylaniline and salts thereof such as sulfate and hydrochloride.

In addition to the above color developing agents, black-and-white developing agents such as phenidone derivatives can be used to form direct positive color image by a color diffusion transfer process using the photographic material of the present invention.

After color development, the photographic emulsion layers are generally bleached. Bleaching and fixing may be carried out simultaneously with one bath for bleaching-fixing treatment, or they may be separately carried out. After bleaching, a bleaching-fixing treatment may be conducted to expedite processing. After fixing, a bleaching-fixing treatment may be carried out. Generally, iron complex salts of aminopolycarboxylic acids are used as bleaching agents for the bleaching solution or bleaching-fixing solution of the present invention. The bleaching solution or bleaching-fixing solution of the present invention may contain additives. For example, compounds described in JP-A-62-215272 (pages 22 to 30) can be used as the additives. After desilverization (bleaching-fixing or fixing), rinsing and/or stabilization are/is carried out. Preferably, softened water is used for rinsing water or stabilizing solution. Examples of methods for softening water include methods using ion exchange resins or reverse osmosis device described in JP-A-62-288838. Concretely, these methods are preferably carried out according to the methods described in JP-A-62-288838.

Compounds described in JP-A-62-215272 (pages 30 to 36) can be used as additives for the rinsing stage and the stabilization stage.

It is preferred that the amount of replenisher in each stage is as small as possible. The amount of the replenisher per unit area of photographic material is preferably 0.1 to 50 times, more preferably 3 to 30 times, the amount brought over from the previous bath.

The present invention is now illustrated in greater detail by reference to the following examples which, however, are not to be construed as limiting the invention in any way.

EXAMPLE 1

Preparation of Light-Sensitive Emulsion

To an aqueous solution of gelatin kept at 50° C., an aqueous solution of silver nitrate and an aqueous solution of potassium iodide and potassium bromide were added at the same time over a 60-minute period in the presence of $4\times10^{-7}$ mol/mol Ag of potassium hexachloroiridate(III) and ammonia. In the course of addition, the pAg of the reaction system was kept at 7.8. Thus, a monodisperse cubic silver iodobromide emulsion having an average grain size of 0.28 μm and a mean iodide content of 0.3 mol% were prepared. This emulsion was desalted using the flocculation process, and thereto was added inert gelatin in an amount of 40 g per mole of silver. Thereafter, the emulsion was kept at 50° C., and thereto were added 5,5'-dichloro-9-ethyl-3,3'-bis(3-sulfopropyl)oxacarbocyanine as a sensitizing dye and $10^{-3}$ mol/mol-Ag of a KI solution. After the lapse of 15 minutes, the temperature of the emulsion was lowered.

Coating of Light-Sensitive Emulsion Layer

The gelatin of the obtained emulsion was dissolved again, and kept at 40° C. Thereto were added one of the redox compounds of the present invention or Comparative Compound-c or -d shown below and one of the compounds represented by the general formula (I) which are set forth in Table 1 specifically, or Comparative Compound-a or -b shown below and further were added 5-methylbenzotriazole, 4-hydroxy-1,3,3*a*, 7-tetrazaindene, the compounds (a) and (b) illustrated below, polyethylacrylate in a proportion of 30 wt% to the gelatin, and the compound (c) illustrated below as a gelatin hardener. The resulting emulsion was coated on a polyethylene terephthalate film (150 μm) having a subbing layer (0.5 μm) of a vinylidene chloride copolymer so as to have a silver coverage of 3.8 g/m².

(a)

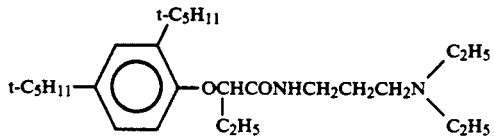

-continued (b)

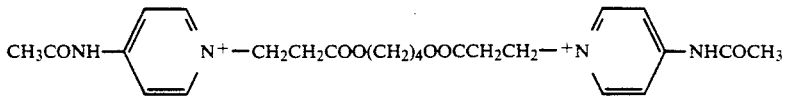

15.0 mg/m²

2Cl⁻

(c)

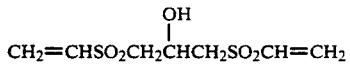

2.0 wt % to gelatin

Coating of Protective Layer

On the emulsion layer were coated gelatin, polymethyl methacrylate particles (an average particle size: 2.5 μm) and fine-grained AgCl (grain size: 0.08 μm) prepared in the manner described below so as to have coverages of 1.5 g/m², 0.3 g/m² and 0.3 g/m² (based on silver), respectively with the aid of the following surface active agents.

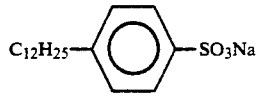

37 mg/m²

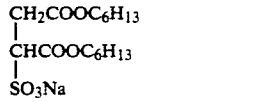

37 mg/m²

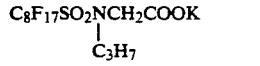

2.5 mg/m²

Evaluation of Properties (1) Halftone Dot Quality:

The thus prepared samples were exposed to tungsten light of 3200° K. through an optical wedge and a contact screen (150 L chain-dot type, produced by Fuji Photo Film Co., Ltd.), developed with the developer described below (Developer-I) at 34° C. for 30 seconds, and then fixed with the fixing solution (GR-F1 made by Fuji Photo Film Co., Ltd.) at room temperature for 20 seconds, washed with running water for 30 seconds and dried through warm air.

The halftone dot quality of these samples and their halftone gradation data are shown in Table 1.

The halftone gradation is represented by the following equation:

| | | |
|---|---|---|
| Halftone Gradation ($\Delta \log E$) | = | Exposure which gives rise to a dot area rate of 95% ($\log E_{95\%}$) |
| | − | Exposure which gives rise to a dot area rate of 5% ($\log E_{5\%}$) |

The halftone dot quality was evaluated in five grades by observation with the naked eye. In the five-grade evaluation, "5" represents the best quality, and "1" represents the worst quality. The grades "5" and "4" are on the level practically usable as halftone original for graphic arts the grade "3" is a barely usable level, and the grades "2" and "1" are below the practically usable level.

The results obtained are shown in Table 1.

As can be seen from the data of Table 1, each sample prepared in accordance with the present invention had a markedly wide halftone gradation and a superior halftone dot quality, compared with the samples prepared for comparison.

| Composition of Developer-I: | |
|---|---|
| Hydroquinone | 50.0 g |
| N-Methyl-p-aminophenol | 0.3 g |
| Sodium hydroxide | 18.0 g |
| 5-Sulfosalicylic acid | 55.0 g |
| Potassium sulfite | 110.0 g |
| Disodium ethylenediaminetetraacetate | 1.0 g |
| Potassium bromide | 10.0 g |
| 5-Methylbenzotriazole | 0.4 g |
| 2-Mercaptobenzimidazole-5-sulfonic acid | 0.3 g |
| Sodium 3-(5-Mercaptotetrazole)benzenesulfonate | 0.2 g |
| N-n-Butyldiethanolamine | 15.0 g |
| Sodium toluenesulfonate | 8.0 g |
| Water to make | 1 l |

The pH was adjusted to 11.5 by the addition of potassium hydroxide.

Comparative Compound-a

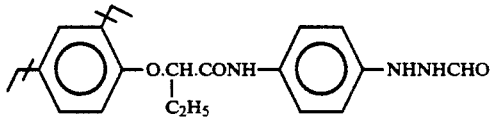

Comparative Compound-b

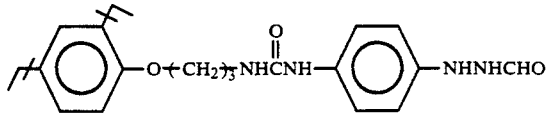

Comparative Compound-c

-continued

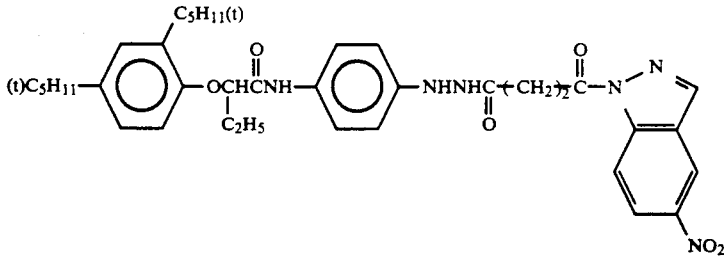

Comparative Compound-d

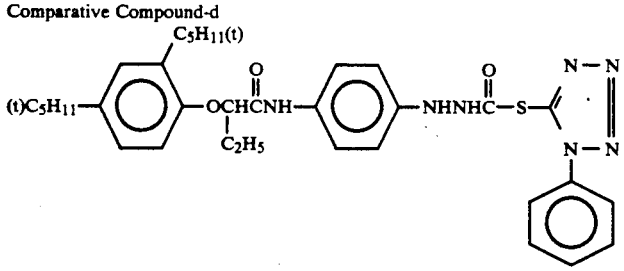

TABLE 1

| Sample | Redox Compound Kind | Redox Compound Amount added (mol/mol Ag) | Compound of Formula (I) Kind | Compound of Formula (I) Amount added (mol/mol Ag) | Halftone Gradation Δ log E | Halftone Dot Quality |
|---|---|---|---|---|---|---|
| Comparison 1 | — | — | a | $2.0 \times 10^{-3}$ | 1.23 | 3 |
| Comparison 2 | — | — | b | $7.0 \times 10^{-4}$ | 1.21 | 3 |
| Comparison 3 | c | $5.7 \times 10^{-4}$ | a | $2.0 \times 10^{-3}$ | 1.33 | 4 |
| Comparison 4 | d | $5.7 \times 10^{-4}$ | a | $2.0 \times 10^{-3}$ | 1.21 | 2 |
| Comparison 5 | c | $5.7 \times 10^{-4}$ | b | $7.0 \times 10^{-4}$ | 1.32 | 4 |
| Comparison 6 | d | $5.7 \times 10^{-4}$ | b | $7.0 \times 10^{-4}$ | 1.19 | 2 |
| Invention 1 | 2-17 | $5.7 \times 10^{-4}$ | 1-5 | $7.0 \times 10^{-4}$ | 1.41 | 4 |
| Invention 2 | 2-17 | $5.7 \times 10^{-4}$ | 1-6 | $7.0 \times 10^{-4}$ | 1.43 | 5 |
| Invention 3 | 2-17 | $5.7 \times 10^{-4}$ | 1-9 | $7.0 \times 10^{-4}$ | 1.40 | 5 |
| Invention 4 | 2-17 | $5.7 \times 10^{-4}$ | 1-10 | $7.0 \times 10^{-4}$ | 1.41 | 4 |
| Invention 5 | 2-17 | $5.7 \times 10^{-4}$ | 1-11 | $7.0 \times 10^{-4}$ | 1.41 | 5 |
| Invention 6 | 2-38 | $5.7 \times 10^{-4}$ | 1-11 | $7.0 \times 10^{-4}$ | 1.46 | 5 |
| Invention 7 | 2-19 | $5.7 \times 10^{-4}$ | 1-11 | $7.0 \times 10^{-4}$ | 1.42 | 5 |
| Invention 8 | 2-17 | $5.7 \times 10^{-4}$ | 1-18 | $7.0 \times 10^{-4}$ | 1.38 | 4 |
| Invention 9 | 2-31 | $5.7 \times 10^{-4}$ | 1-18 | $7.0 \times 10^{-4}$ | 1.39 | 4 |
| Invention 10 | 2-35 | $5.7 \times 10^{-4}$ | 1-22 | $7.0 \times 10^{-4}$ | 1.38 | 5 |
| Invention 11 | 2-41 | $8.6 \times 10^{-5}$ | 1-10 | $7.0 \times 10^{-4}$ | 1.42 | 4 |
| Invention 12 | 2-45 | $8.6 \times 10^{-5}$ | 1-10 | $7.0 \times 10^{-4}$ | 1.44 | 4 |

EXAMPLE 2

Each of the samples prepared in Example 1 was exposed in the same manner as in Example 1, and then developed at 34° C. for 30 seconds using an automatic developing machine for photomechanical process (Model FG 660F, produced by Fuji Photo Film Co., Ltd.) charged with the same developer (Developer-I) as used in Example 1 under three different conditions described below. Thereafter, it was fixed, washed, and then dried. In the fixing vessel of the developing machine, Fuji's GR-F1 was used.

Condition (A):

Immediately after the temperature of the developer filling the automatic developing machine reached 34° C., development-processing was carried out. (Development with the fresh developer)

Condition (B):

After the developer had been left filling into the automatic developing machine for 4 days, development-processing was carried out. (Development with the aerially exhausted developer)

Condition (C):

After the automatic developing machine was charged with the developer, the film, GRANDEX GA-100, measuring 50.8 cm×61.0 cm in size, produced by Fuji Photo Film Co. Ltd., which each had been exposed so that 50% area might be developed, was processed in a quantity of 200 sheets per day. This development-processing was continued for 5 days. Hereon, the developer was replenished in an amount of 100 ml per sheet. (Development with the developer exhausted by mass processing)

The thus exhausted developer was used for examining for running development stability.

The photographic properties checked are shown in Table 2. These data imply that the smaller the differences in characteristic value between the conditions (B) and (A), and between the conditions (C) and (A), the more excellent the running development stability of the light-sensitive material.

That is, the use of the compounds of this invention has proved to bring about a much greater improvement in running development stability than we expected.

TABLE 2

| Sample | Running Development Stability: Aerially Exhausted Developer ($\Delta S_{B-A}$*) | Developer Exhausted by Mass Processing ($\Delta S_{C-A}$*) |
|---|---|---|
| Comparison 1 | +0.23 | −0.39 |
| Comparison 2 | +0.16 | −0.26 |
| Comparison 3 | +0.19 | −0.24 |
| Comparison 4 | +0.25 | −0.40 |
| Comparison 5 | +0.14 | −0.42 |
| Comparison 6 | +0.19 | −0.29 |
| Invention 1 | +0.08 | −0.11 |
| Invention 2 | +0.10 | −0.16 |
| Invention 3 | +0.09 | −0.10 |
| Invention 4 | +0.08 | −0.09 |
| Invention 5 | +0.12 | −0.13 |
| Invention 6 | +0.11 | −0.10 |
| Invention 7 | +0.12 | −0.16 |
| Invention 8 | +0.12 | −0.15 |
| Invention 9 | +0.10 | −0.11 |
| Invention 10 | +0.08 | −0.09 |
| Invention 11 | +0.06 | −0.10 |
| Invention 12 | +0.07 | −0.09 |

*$\Delta S_{B-A}$: Difference between the sensitivity achieved by the development with the aerially exhausted developer ($S_B$) and the sensitivity achieved by the development with the fresh developer ($S_A$)
$\Delta S_{C-A}$: Difference between the sensitivity achieved by the development with the developer which had been exhausted by mass processing ($S_C$) and the sensitivity and the sensitivity achieved by the development with the fresh developer ($S_A$)

EXAMPLE 3

To an aqueous solution of gelatin kept at 50° C., an aqueous solution of silver nitrate and an aqueous solution of sodium chloride were added at the same time in the presence of $5.0\times10^{-6}$ mol/mol-Ag of $(NH_4)_3RhCl_6$. After soluble salts were removed using a method well-known to one skilled in the arts, gelatin was added to the resulting emulsion. Further, 2-methyl-4-hydroxy-1,3,3*a*,7-tetraazaindene was added as stabilizer without subjecting the emulsion to chemical ripening. Thus, a monodisperse cubic silver chloride emulsion having an average grain size of 0.15 μm was obtained.

Thereto were added one of the redox compounds of the present invention or Comparative Compound-c or -d shown above and one of the compounds represented by the general formula (I), which are set forth in Table 3 specifically, or Comparative Compound-a or -b shown above and further were added a polyethylacrylate latex in a proportion of 30 wt% to the gelatin on a solids basis, and 1,3-vinylsulfonyl-2-propanol as a hardener. The thus prepared emulsion was coated on a polyester support so as to have a silver coverage of 3.8 g/m². Gelatin content was 1.8 g/m². On the emulsion layer were coated a protective layer containing 1.5 g/m² of gelatin, 0.3 g/m² of polymethylmethacrylate particles (an average particle size: 2.5 μm), and further the following surface active agents, stabilizer and ultraviolet absorbing dye, followed by drying.

(Surface Active Agent)

-continued

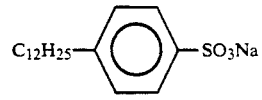

37 mg/m²

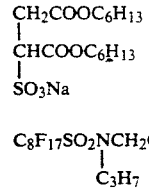

37 mg/m²

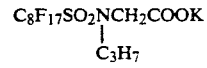

2.5 mg/m²

(Stabilizer)
Thioctoic acid 2.1 mg/m²

(Ultraviolet Absorbing Dye)

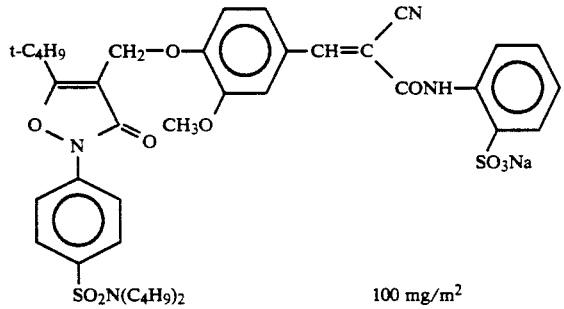

100 mg/m²

These samples each were exposed imagewise through originals as shown in FIG. 1 by means of a daylight printer P-607, made by Dainippon Screen Mfg. Co., Ltd., and subjected to successive 20 seconds, development at 38° C., fixation, washing and drying. Then, letter image qualities of the processed samples were evaluated.

The quality "5" of letter images referred to such a quality that when originals and a contact light-sensitive material were so arranged as to have the configuration illustrated in FIG. 1 and thereto, a correct exposure, by which 50% dot area on the halftone original could be reproduced as 50% dot area on the contact light-sensitive material, was given, letters having a line width of 30 μm could be reproduced on the contact light-sensitive material, that is to say, very excellent quality. On the other hand, the quality "1" of letter images referred to such a quality that when the same correct exposure as described above was given, letters having a line width of 150 μm or more could barely be reproduced, that is to say, inferior quality. Three grades 4, 3 and 2 were made between the quality "5" and the quality "1" on a basis of sensory evaluation. The grades not lower than 3 were on a practically usable level.

The results obtained are shown in Table 3. The samples of this invention were excellent in letter image quality.

TABLE 3

| Sample | Redox Compound: Kind | Redox Compound: Amount added (mol/mol Ag) | Compound of Formula (I): Kind | Compound of Formula (I): Amount added (mol/mol Ag) | Letter Image Quality | Running Development Stability: Aerially exhausted Developer | Running Development Stability: Developer exhausted by Mass Processing |
|---|---|---|---|---|---|---|---|
| Comparison 1 | — | — | a | $5.0\times10^{-3}$ | 2.5 | +0.17 | −0.25 |
| Comparison 2 | — | — | b | $1.8\times10^{-3}$ | 3.0 | +0.09 | −0.16 |
| Comparison 3 | c | $1.4\times10^{-3}$ | a | $5.0\times10^{-3}$ | 3.0 | +0.15 | −0.21 |
| Comparison 4 | d | $1.4\times10^{-3}$ | a | $5.0\times10^{-3}$ | 2.5 | +0.20 | −0.29 |
| Comparison 5 | c | $1.4\times10^{-3}$ | b | $1.8\times10^{-3}$ | 3.5 | +0.07 | −0.13 |

TABLE 3-continued

| Sample | Redox Compound Kind | Redox Compound Amount added (mol/mol Ag) | Compound of Formula (I) Kind | Compound of Formula (I) Amount added (mol/mol Ag) | Letter Image Quality | Running Development Stability: Aerially exhausted Developer | Running Development Stability: Developer exhausted by Mass Processing |
|---|---|---|---|---|---|---|---|
| Comparison 6 | d | $1.4 \times 10^{-3}$ | b | $1.8 \times 10^{-3}$ | 3.0 | +0.13 | −0.20 |
| Invention 1 | 2-17 | $1.4 \times 10^{-3}$ | 1-5 | $1.8 \times 10^{-3}$ | 4.5 | +0.04 | −0.07 |
| Invention 2 | 2-17 | $1.4 \times 10^{-3}$ | 1-6 | $1.8 \times 10^{-3}$ | 4.5 | +0.04 | −0.09 |
| Invention 3 | 2-17 | $1.4 \times 10^{-3}$ | 1-9 | $1.8 \times 10^{-3}$ | 4.5 | +0.04 | −0.07 |
| Invention 4 | 2-17 | $1.4 \times 10^{-3}$ | 1-10 | $1.8 \times 10^{-3}$ | 4.5 | +0.02 | −0.07 |
| Invention 5 | 2-17 | $1.4 \times 10^{-3}$ | 1-11 | $1.8 \times 10^{-3}$ | 4.0 | +0.05 | −0.08 |
| Invention 6 | 2-38 | $1.4 \times 10^{-3}$ | 1-11 | $1.8 \times 10^{-3}$ | 4.0 | +0.05 | −0.09 |
| Invention 7 | 2-19 | $1.4 \times 10^{-3}$ | 1-11 | $1.8 \times 10^{-3}$ | 4.0 | +0.04 | −0.10 |
| Invention 8 | 2-17 | $1.4 \times 10^{-3}$ | 1-18 | $1.8 \times 10^{-3}$ | 4.0 | +0.05 | −0.10 |
| Invention 9 | 2-31 | $1.4 \times 10^{-3}$ | 1-18 | $1.8 \times 10^{-3}$ | 4.0 | +0.04 | −0.09 |
| Invention 10 | 2-35 | $1.4 \times 10^{-3}$ | 1-22 | $1.8 \times 10^{-3}$ | 4.5 | +0.04 | −0.08 |
| Invention 11 | 2-41 | $1.4 \times 10^{-3}$ | 1-10 | $1.8 \times 10^{-3}$ | 4.5 | +0.03 | −0.07 |
| Invention 12 | 2-45 | $1.4 \times 10^{-3}$ | 1-10 | $1.8 \times 10^{-3}$ | 4.5 | +0.03 | −0.08 |

EXAMPLE 4

Each of the samples prepared in Example 3 was exposed in the same manner as in Example 2, and then developed at 34° C. for 30 seconds using an automatic developing machine for photomechanical process (Model FG 660F, produced by Fuji Photo Film Co., Ltd.) charged with the same developer (Developer-I) as used in Example 1 under three different conditions described below. Thereafter, it was fixed, washed, and then dried in the same manner as in Example 2.

Condition (A):

Immediately after the temperature of the developer filling the automatic developing machine reached 34° C., development-processing was carried out. (development with the fresh developer)

Condition (B):

After the developer had been left filling into the automatic developing machine for 4 days, development-processing was carried out. (Development with the aerially exhausted developer)

Condition (C):

After the automatic developing machine was charged with the developer, the film, GRANDEX VU-100, measuring 50.8 cm×61.0 cm in size, produced by Fuji Photo Film Co. Ltd., which each had been exposed so that 50% area might be developed, was processed in a quantity of 200 sheets per day. This development-processing was continued for 5 days. Herein, the developer was replenished in an amount of 100 ml per sheet. (Development with the developer exhausted by mass processing)

The thus exhausted developer was used for examining for running development stability.

The photographic properties checked are also shown in Table 3. The measurements were obtained in the same manner as explained for Table 2. These data imply that the smaller the differences in characteristic value between the conditions (B) and (A), and between the conditions (C) and (A), the more excellent the running development stability of the light-sensitive material.

That is, the use of the compounds of this invention has proved to bring about a much greater improvement in running development stability than we expected.

While the invention has been described in detail and with reference to specific embodiments thereof, it will be apparent to one skilled in the art that various changes and modifications can be made therein without departing from the spirit and scope thereof.

What is claimed is:

1. A silver halide photographic material which contains (a) at least one redox compound represented by the following general formula (II):

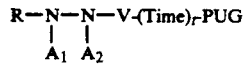

(II)

wherein both $A_1$ and $A_2$ represents hydrogen atoms, or one of them represents a hydrogen atom and the other represents a sulfinic acid residual group or

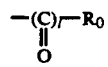

wherein $R_0$ represents an alkyl group, an alkenyl group, an aryl group, an alkoxy group, or an aryloxy group, and l represents 1 or 2; TIME represents a divalent group which contains a hetero atom and which is bonded to the V group through the hetero atom; t represents 0 or 1; PUG represents a development inhibitor group which contains a hetero atom and which is bonded to either the TIME group or the V group through a hetero atom in the PUG; V represents a carbonyl group,

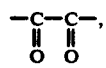

a sulfonyl group, a sulfoxy group,

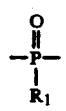

wherein $R_1$ represents an alkoxy group or an aryloxy group, an iminomethylene group, or a thiocarbonyl group; and R represents an aliphatic group, an aromatic group, or a heterocyclic group; and (b) at least one compound represented by the following formula (I):

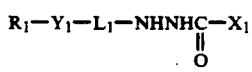

(I)

wherein $R_1$ represents an aliphatic group, an aromatic group, or a heterocyclic group; $L_1$ represents an arylene group; $X_1$ represents a hydrogen atom, an aliphatic group, an aromatic group, or a heterocyclic group; and $Y_1$ represents —0—, —$SO_2NH$— or $$-Y_2-\overset{\overset{\displaystyle O}{\|}}{\underset{\underset{\displaystyle Y_2-R_1}{|}}{P}}-NH-$$

wherein $Y_2$ represents —O—, —NH—, or $$-\underset{\underset{\displaystyle R_1}{|}}{N}-.$$

* * * * *